US007806497B2

(12) United States Patent
Mitsuzawa

(10) Patent No.: US 7,806,497 B2
(45) Date of Patent: Oct. 5, 2010

(54) PRINTING METHOD, COMPUTER-READABLE MEDIUM, AND PRINTING APPARATUS

(75) Inventor: Toyohiko Mitsuzawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/420,544

(22) Filed: Apr. 8, 2009

(65) Prior Publication Data

US 2009/0244140 A1 Oct. 1, 2009

Related U.S. Application Data

(63) Continuation of application No. 11/010,649, filed on Dec. 14, 2004, now abandoned.

(30) Foreign Application Priority Data

Dec. 16, 2003 (JP) ..... 2003-418669

(51) Int. Cl.
*B41J 29/38* (2006.01)
*B41J 2/15* (2006.01)
*B41J 2/145* (2006.01)

(52) U.S. Cl. ..... 347/12; 347/14; 347/40

(58) Field of Classification Search ..... 347/12, 347/14, 40

See application file for complete search history.

(56) References Cited

U.S. PATENT DOCUMENTS 5,450,099 A 9/1995 Stephenson et al.
5,835,108 A 11/1998 Beauchamp et al.
6,312,099 B1 11/2001 Hawkins et al.
6,547,355 B1 * 4/2003 Shimada et al. ..... 347/12
6,578,950 B2 * 6/2003 Matsumoto et al. ..... 347/42
6,764,164 B2 7/2004 Kuwahara
7,077,502 B2 7/2006 Mitsuzawa
2003/0048326 A1 3/2003 Yamasaki et al.

FOREIGN PATENT DOCUMENTS

JP 05-238004 A 9/1993
JP 2001-001510 A 1/2001
JP 2001-1510 A 1/2001
JP 2003-341037 A 12/2003

* cited by examiner

*Primary Examiner*—Julian D Huffman
(74) *Attorney, Agent, or Firm*—Sughrue Mion, PLLC

(57) ABSTRACT

A printing method etc. capable of suppressing degradation in image quality of border sections between regions respectively printed by a plurality of nozzle rows that eject ink droplets is achieved. The printing method includes a step of setting, when at least two print heads that move in a movement direction intersecting a carrying direction and that include a plurality of nozzle rows each including a plurality of nozzles arranged in the carrying direction are moved in the movement direction, one ejecting method, of among a plurality of ejecting methods in which the nozzles for actually ejecting ink droplets are appropriately changed between an upstream-side nozzle and a downstream-side nozzle, for each of a plurality of aligned nozzle sections that are arranged such that the downstream-side nozzle of one print head and the upstream-side nozzle of the other print head, of the nozzle rows provided in different print heads, are aligned in the movement direction; and a step of ejecting ink droplets from the aligned nozzle sections according to the one ejecting method that has been set.

3 Claims, 21 Drawing Sheets

| aligned nozzle section | K | C | LC | M | LM | Y |
|---|---|---|---|---|---|---|
| AB | 8 | 7 | 6 | 5 | 4 | 3 |
| BC | 12 | 13 | 14 | 15 | 16 | 17 |
| CD | 10 | 10 | 10 | 10 | 10 | 10 |
| DA | 10 | 10 | 10 | 10 | 10 | 10 |

If print heads and nozzles are ideally formed and arranged

| aligned nozzle section | K | C | LC | M | LM | Y |
|---|---|---|---|---|---|---|
| AB | fifth ink-ejecting method | fifth ink-ejecting method | fifth ink-ejecting method | fifth ink-ejecting method | fifth ink-ejecting method | fifth ink-ejecting method |
| BC | fifth ink-ejecting method | fifth ink-ejecting method | fifth ink-ejecting method | fifth ink-ejecting method | fifth ink-ejecting method | fifth ink-ejecting method |
| CD | fifth ink-ejecting method | fifth ink-ejecting method | fifth ink-ejecting method | fifth ink-ejecting method | fifth ink-ejecting method | fifth ink-ejecting method |
| DA | fifth ink-ejecting method | fifth ink-ejecting method | fifth ink-ejecting method | fifth ink-ejecting method | fifth ink-ejecting method | fifth ink-ejecting method |

If the print head B is attached in a tilted manner

| aligned nozzle section | K | C | LC | M | LM | Y |
|---|---|---|---|---|---|---|
| AB | third ink-ejecting method | fourth ink-ejecting method | first ink-ejecting method | fourth ink-ejecting method | second ink-ejecting method | fourth ink-ejecting method |
| BC | first ink-ejecting method | second ink-ejecting method | fourth ink-ejecting method | third ink-ejecting method | third ink-ejecting method | first ink-ejecting method |
| CD | fifth ink-ejecting method | fifth ink-ejecting method | fifth ink-ejecting method | fifth ink-ejecting method | first ink-ejecting method | fifth ink-ejecting method |
| DA | fifth ink-ejecting method | fifth ink-ejecting method | fourth ink-ejecting method | fifth ink-ejecting method | fifth ink-ejecting method | fifth ink-ejecting method |

Fig.21

PRINTING METHOD, COMPUTER-READABLE MEDIUM, AND PRINTING APPARATUS

CROSS-REFERENCE TO RELATED APPLICATIONS

The present application is a Continuation of U.S. application Ser. No. 11/010,649 filed Dec. 14, 2004, which claims priority from Japanese Patent Application No. 2003-418669 filed on Dec. 16, 2003. The entire disclosures of the aforementioned prior applications are hereby incorporated by reference in their entirety.

BACKGROUND OF THE INVENTION

1. Field of the Invention

The present invention relates to printing methods, computer-readable media, and printing apparatuses.

2. Description of the Related Art

In recent years, printing apparatuses that print using print heads, which are provided with a plurality of nozzle rows that eject ink droplets of a plurality of colors color by color and that are arranged in the carrying direction of the print paper, have been considered. In such printing apparatuses, the print heads are configured by assembling a plurality of nozzle rows ejecting ink droplets of the same color.

When printing is performed using such a print head, there may be cases in which adjacent regions are respectively printed by different nozzle rows disposed in the carrying direction; however, there is a possibility that the image quality at the border between regions that are printed by different nozzle rows may deteriorate because of the difference in the characteristics of the nozzle rows. Thus, a number of methods for ejecting ink droplets have been considered for suppressing deterioration in image quality, by arranging the different nozzle rows that are arranged in the carrying direction such that a predetermined number of nozzles in each nozzle row are aligned in the head movement direction and by printing by alternately ejecting ink droplets from the nozzles of the different nozzle rows that are aligned in the movement direction.

However, in the foregoing printing method, it is a precondition that the predetermined number of nozzles in each of the two nozzle rows that respectively print the adjacent regions are arranged such that they are aligned in the head movement direction. Thus, in cases in which the attachment position of the nozzle rows is shifted or if they are attached in a tilted manner due to an attachment error, for example, then there is a possibility that the number of nozzles that are arranged so as to be aligned in the head movement direction in the two nozzle rows may deviate from the predetermined number. In such a case, it may not be possible to suppress deterioration of image quality at the border of adjacent regions with the foregoing ink-droplet-ejecting method. Thus, there is an issue that it is not possible to suppress deterioration of the image quality of the entire printed image.

SUMMARY OF THE INVENTION

The present invention has been made in consideration of such issues, and it is an object thereof to achieve a printing method, a computer-readable medium, and a printing apparatus that are capable of suppressing deterioration in image quality at a border section between regions printed by a plurality of nozzle rows that eject ink droplets.

A primary aspect of the invention is a printing method such as the following.

A printing method comprises the steps of:

(a) preparing a printing apparatus that has:

at least two print heads that move in a movement direction intersecting a carrying direction, each of the print heads including a plurality of nozzle rows, each of the nozzle rows including a plurality of nozzles that are arranged in the carrying direction and that are capable of forming dots by ejecting ink droplets onto a medium that is carried in the carrying direction, and a plurality of aligned nozzle sections aligned in the movement direction, each of the aligned nozzle sections being constituted by at least one downstream-side nozzle that is positioned on the downstream side in the carrying direction of the nozzle rows provided in one of the print heads and at least one upstream-side nozzle that is positioned on the upstream side of the nozzle rows provided in another one of the print heads;

(b) setting, for each of the aligned nozzle sections, one ejecting method of among a plurality of ejecting methods employing different ways of using the at least one upstream-side nozzle and the at least one downstream-side nozzle when the print heads move in the movement direction; and (c) ejecting ink droplets from the aligned nozzle sections according to the one ejecting method that has been set for each of the aligned nozzle sections.

Other features of the present invention are made clear with the accompanying drawings and the description below.

BRIEF DESCRIPTION OF THE DRAWINGS

For a more complete understanding of the present invention and the advantages thereof, reference is now made to the following description taken in conjunction with the accompanying drawings.

FIG. 21 is a diagram showing information that is determined from a printed image and that is stored in a memory as the ink-ejecting method for the aligned nozzle sections of the nozzle rows of each ink color.

DETAILED DESCRIPTION OF THE PREFERRED EMBODIMENTS

Figure 1:
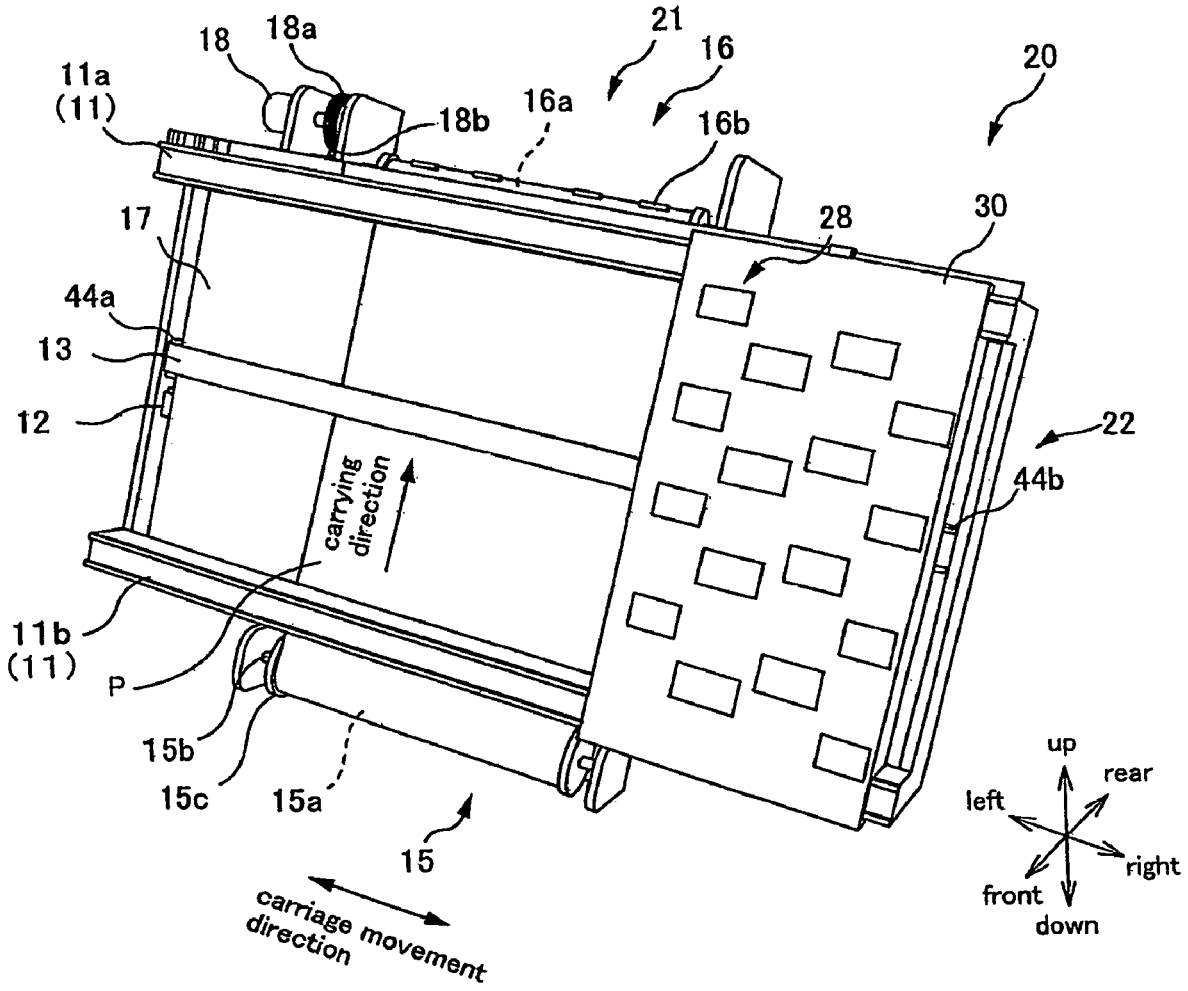
FIG. 1 is a perspective view showing an overview of the configuration of an inkjet printer, as a printing apparatus according to the present invention.

At least the following matters will be made clear by the present specification and the description of the accompanying drawings.

A printing method comprises the steps of:

(a) preparing a printing apparatus that has:

at least two print heads that move in a movement direction intersecting a carrying direction, each of the print heads including a plurality of nozzle rows, each of the nozzle rows including a plurality of nozzles that are arranged in the carrying direction and that are capable of forming dots by ejecting ink droplets onto a medium that is carried in the carrying direction, and a plurality of aligned nozzle sections aligned in the movement direction, each of the aligned nozzle sections being constituted by at least one downstream-side nozzle that is positioned on the downstream side in the carrying direction of the nozzle rows provided in one of the print heads and at least one upstream-side nozzle that is positioned on the upstream side of the nozzle rows provided in another one of the print heads;

(b) setting, for each of the aligned nozzle sections, one ejecting method of among a plurality of ejecting methods employing different ways of using the at least one upstream-side nozzle and the at least one downstream-side nozzle when the print heads move in the movement direction; and (c) ejecting ink droplets from the aligned nozzle sections according to the one ejecting method that has been set for each of the aligned nozzle sections.

With such a printing method, it is possible to set the ejecting method for each aligned nozzle section made of nozzle rows provided in the print heads that are adjacent in the carrying direction and thus it is possible to set the ejecting method in accordance with the condition of the upstream-side nozzles and the downstream-side nozzles contained in the aligned nozzle sections. That is to say, it is possible to appropriately switch the nozzles that eject the ink droplets between the upstream-side nozzles of one print head and the downstream-side nozzles of the other print head to print the border section between regions respectively printed by different print heads. Thus, white streaks, black streaks, and roughness due to the dots caused by, for example, the ejection characteristics of the ink droplets or errors in the ejection precision of the ink droplets in the upstream-side nozzles and the downstream-side nozzles of the border section of the print regions that are respectively printed by two different print heads, do not easily occur, and thus it is possible to suppress deterioration in image quality.

It is desirable that the one ejecting method is set based on a number of aligned nozzles in the aligned nozzle section.

With such a printing method, it is possible to print a favorable image by an ejecting method in accordance with the number of nozzles aligned in the aligned nozzle section. In particular, since the aligned nozzle section is configured of a plurality of nozzle rows that are provided in different print heads, it is still possible to print a favorable image through the ejecting method that is set according to the number of nozzles that are aligned in the aligned nozzle section, even if the number of nozzles that are aligned differs for each nozzle row due to errors in, for example, the attachment of the print heads.

Furthermore, it is preferable that the one ejecting method is set based on a result of printing a predetermined pattern using the plurality of ejecting methods.

With such a printing method, since the ejecting method of each of the aligned nozzle sections is set based on patterns that are actually printed with the aligned nozzle sections using the respective ejecting methods, it is possible to set the most appropriate ejecting method as the ejecting method for each aligned nozzle section based on the pattern printed by the plurality of ejecting methods. Thus, it is possible to print a more favorable image.

It is desirable that the predetermined pattern is an image that includes a halftone region.

Since the amount of dots formed per unit area, i.e., the so-called dot density, in the halftone region in the image is low, the shape of the dot may become more easily noticeable and the image quality may deteriorate in case the position of a formed dot is shifted. In particular, if the upstream-side nozzles and the downstream-side nozzles in the aligned nozzle section have different ejection characteristics, then the image quality tends to deteriorate because the position of the dots formed by the upstream-side nozzles and the downstream-side nozzles are both shifted from the target position; however, with the above-described ink-droplet-ejecting method, since the ejecting method of the aligned nozzle section is set based on the results of printing an image that includes a halftone region, it is possible to suppress degradation of image quality in which dot shapes in the image become noticeable, for example.

The predetermined pattern may be an image that includes a region in which a dot density is high.

For a region in which the dot density is high, if the ejection position of ink droplets of adjacent nozzle rows is nearer to or further from an ideal ejection position, then black streaks or white streaks tend to occur; however, with the above-described ink-droplet-ejecting method, since the ejecting method of the aligned nozzle sections is set in accordance with the result of printing an image that includes a region in which the dot density is high, it is possible to suppress degradation of print quality caused by black streaks and white streaks, for example.

It is preferable that the plurality of ejecting methods include an ejecting method in which dots are formed on the medium by ink droplets that are ejected from both the at least one upstream-side nozzle and the at least one downstream-side nozzle.

With such a printing method, the plurality of ejecting methods include an ejecting method in which dots are formed on the medium by ink droplets that are ejected from the at least one upstream-side nozzle and the at least one downstream-side nozzle, and thus it is possible to print a favorable image by intermixing the dots formed by the at least one upstream-side nozzle and the dots formed by the at least one downstream-side nozzle in the print region of the medium printed by the aligned nozzle section. In particular, if the at least one upstream-side nozzle and the at least one downstream-side nozzle each have different ink droplet ejection characteristics, it is possible to print a favorable image without letting the ejection characteristics of the at least one upstream-side nozzle and the at least one downstream-side nozzle stand out.

It is desirable that the plurality of ejecting methods include ejecting methods for which a ratio of a number of dots formed by ejecting ink droplets from the at least one upstream-side nozzle to a number of dots formed by ejecting ink droplets from the at least one downstream nozzle when printing a printing region with the aligned nozzle section differs among one another.

With such a printing method, because regularly-appearing unevenness, for example, does not easily occur by employing ejecting methods in which the ratio of the number of dots formed by ejecting ink droplets from the at least one upstream-side nozzle to the number of dots formed by ejecting ink droplets from the at least one downstream nozzle differs from one another, it is possible to print a more favorable image by setting an ejecting method having a ratio that suits each aligned nozzle section.

It is desirable that the plurality of ejecting methods include an ejecting method in which ink droplets are ejected from only either one of the at least one upstream-side nozzle and the at least one downstream-side nozzle.

With such a printing method, even if one of the at least one upstream-side nozzle or the at least one downstream-side nozzle has an inconsistency in nozzle pitch, for example, it is still possible to suppress degradation of image quality caused by, for example, black streaks and white streaks, and to print a favorable image by printing the print region that is printed by the aligned nozzle section only with nozzles that have no pitch inconsistency, for example.

It is desirable that each of the print heads is removable.

There is a possibility that attachment errors, for example, may occur when the print heads are removed and reattached; with the above-described printing method, it is possible to set the ejecting method in accordance with how the print head has been reattached even if the state of the at least one upstream-side nozzle and the at least one downstream-side nozzle of the aligned nozzle section has changed due to errors that have occurred. Thus, the above-noted printing method gives a particularly superior effect in printing apparatuses in which the print heads are removable.

It is desirable that the plurality of nozzles are capable of ejecting ink of a plurality of colors; and that the color of the ink to be ejected is set for each of the nozzle rows.

Color images are printed by overlapping single-color images that are individually formed by a plurality of colors of ink; with the above-noted printing method, it is possible to favorably print the single-color image of each ink color because the ink-droplet-ejecting method when printing with the aligned nozzle section can be set for each ink color. Therefore, white streaks, black streaks, and roughness due to dots do not easily occur even in a color image which is formed by overlapping, and thus it is possible to suppress degradation in image quality and to print a favorable image.

Furthermore, it is possible to achieve a computer-readable medium that has the following codes in order to cause a printing apparatus to print on a medium.

Here, the printing apparatus has at least two print heads that move in a movement direction intersecting a carrying direction, each of the print heads including a plurality of nozzle rows, each of the nozzle rows including a plurality of nozzles that are arranged in the carrying direction and that are capable of forming dots by ejecting ink droplets onto a medium that is carried in the carrying direction, and a plurality of aligned nozzle sections aligned in the movement direction, each of the aligned nozzle sections being constituted by at least one downstream-side nozzle that is positioned on the downstream side in the carrying direction of the nozzle rows provided in one of the print heads and at least one upstream-side nozzle that is positioned on the upstream side of the nozzle rows provided in another one of the print heads; and the computer-readable medium comprises:

(a) a code for setting, for each of the plurality of aligned nozzle sections, one ejecting method of among a plurality of ejecting methods employing different ways of using the at least one upstream-side nozzle and the at least one downstream-side nozzle when the at least two print heads move in the movement direction; and (b) a code for ejecting ink droplets from the aligned nozzle sections according to the one ejecting method that has been set for each of the aligned nozzle sections.

Furthermore, it is also possible to achieve a printing apparatus comprising:

(a) at least two print heads that move in a movement direction intersecting a carrying direction, each of the print heads including a plurality of nozzle rows, each of the nozzle rows including a plurality of nozzles that are arranged in the carrying direction and that are capable of forming dots by ejecting ink droplets onto a medium that is carried in the carrying direction;

(b) a plurality of aligned nozzle sections aligned in the movement direction, each of the aligned nozzle sections being constituted by at least one downstream-side nozzle that is positioned on the downstream side in the carrying direction of the nozzle rows provided in one of the print heads and at least one upstream-side nozzle that is positioned on the upstream side of the nozzle rows provided in another one of the print heads; and (c) a controller, the controller being adapted to set, for each of the aligned nozzle sections, one ejecting method of among a plurality of ejecting methods employing different ways of using the at least one upstream-side nozzle and the at least one downstream-side nozzle when the print heads move in the movement direction, and cause ejection of ink droplets from the aligned nozzle sections according to the one ejecting method that has been set for each of the aligned nozzle sections.

Furthermore, it is also possible to achieve a printing system comprising a main computer unit and a printing apparatus that is connected to the main computer unit and that is provided with at least two print heads that move in a movement direction intersecting a carrying direction, each of the print heads including a plurality of nozzle rows, each of the nozzle rows including a plurality of nozzles that are arranged in the carrying direction and that are capable of forming dots by ejecting ink droplets onto a medium that is carried in the carrying direction; wherein the printing apparatus is so configured as to include a plurality of aligned nozzle sections, in each of which a downstream-side nozzle that is positioned on the downstream side in the carrying direction of the nozzle rows provided in one of the print heads, of among the nozzle rows provided in each of the different print heads, and an upstream-side nozzle that is positioned on the upstream side of the nozzle rows provided in another one of the print heads are aligned in the movement direction; wherein the printing apparatus is capable of ejecting ink droplets using a plurality of ejecting methods in which the nozzles for actually ejecting the ink droplets are appropriately changed between the upstream-side nozzle and the downstream-side nozzle of the aligned nozzle section when the print heads move in the movement direction; and wherein the ink-droplet-ejecting method for the aligned nozzle section can be set to one ejecting method of among the plurality of ejecting methods for each of the aligned nozzle sections.

===Overall Configuration of Printing Apparatus===

Figure 2:
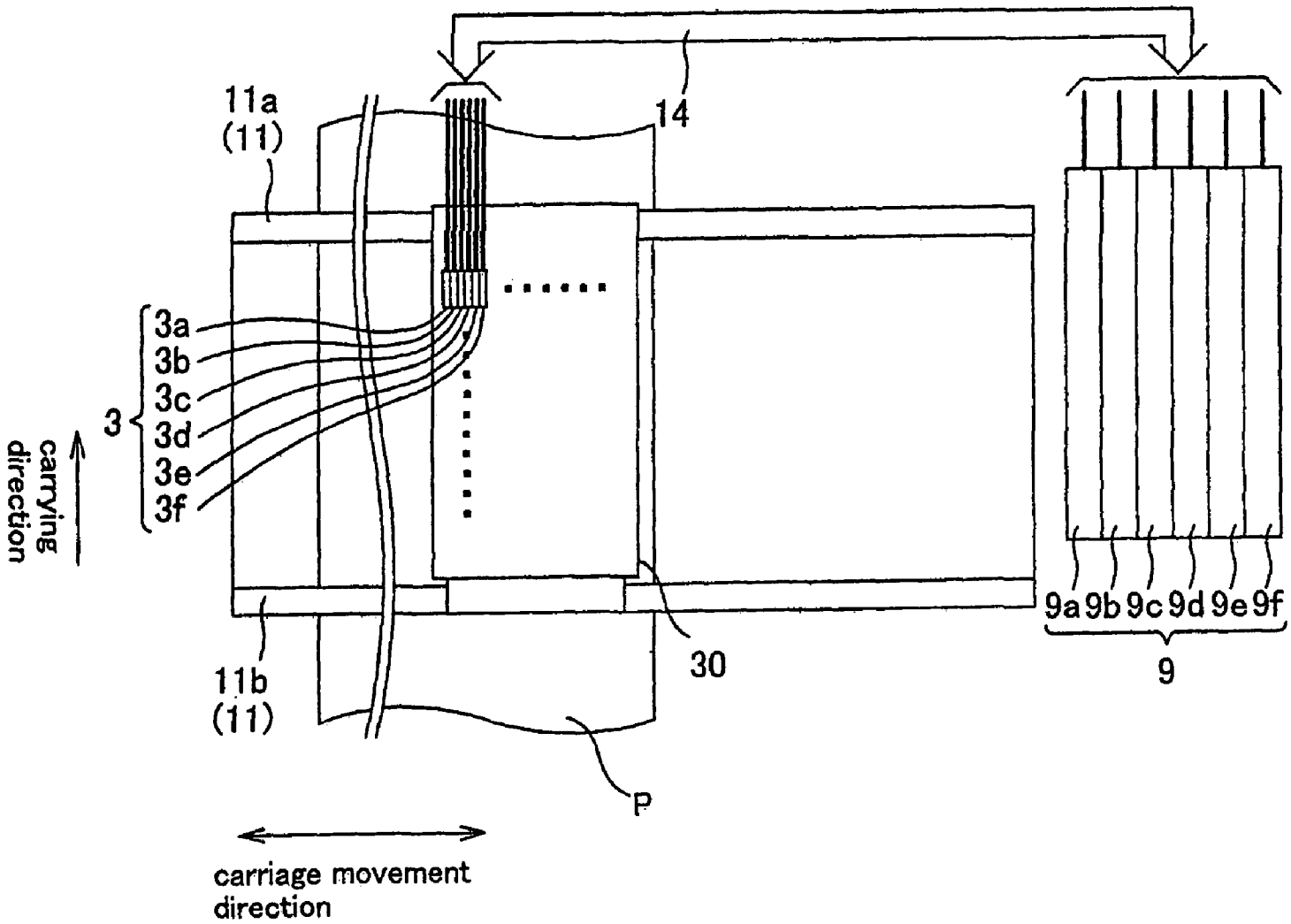
FIG. 2 is an explanatory diagram showing an overview of the configuration of a print section of the inkjet printer.
Figure 3:
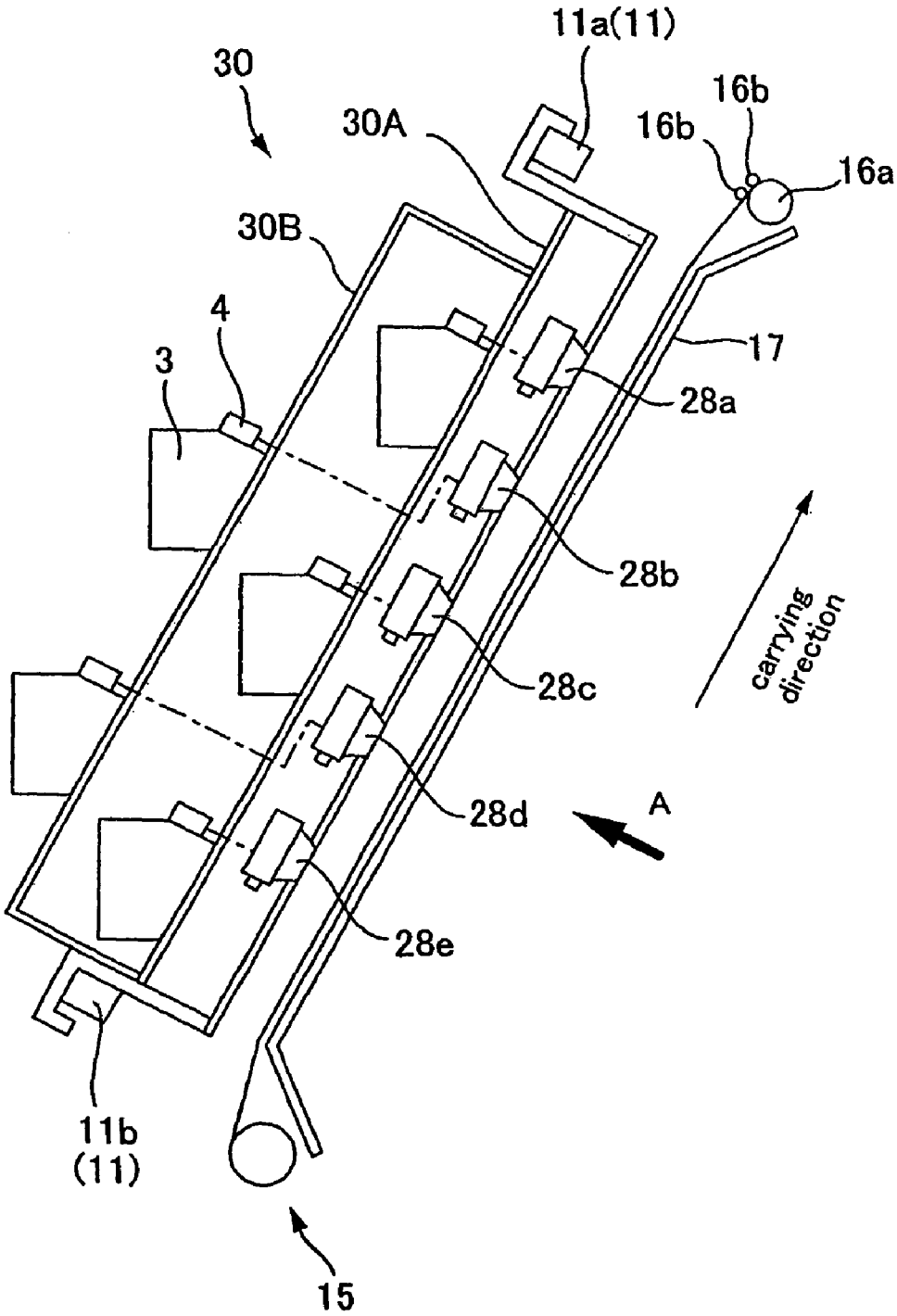
FIG. 3 is a cross-sectional view for explaining the print section.

FIG. 1 is a perspective view showing an overview of the configuration of an inkjet printer as the printing apparatus according to the present invention, FIG. 2 is an explanatory diagram showing an overview of the configuration of a print section contained in the inkjet printer, and FIG. 3 is a cross-sectional view for describing the print section.

The inkjet printer (in the following also referred to as "printer") 20, which is a printing apparatus in accordance with the present invention, is a printer adapted to handle relatively large print paper P, such as roll paper or A0 or B0 size paper according to the JIS standard. The printer 20 has a print section 22 for printing on print paper P by ejecting ink, and a print paper carry section 21 for carrying the print paper P. The various sections are described below.

===Print Section===

The print section 22 is provided with a carriage 30 holding a plurality of print heads 28, a pair of upper and lower guide rails 11 for guiding the carriage 30 such that it can move back and forth in a direction (also referred to as the "carriage movement direction" or the "left-to-right direction" in the following) that is substantially perpendicular to the direction in which the print paper P is carried, a carriage motor 12 for moving the carriage 30 back and forth, and a drive belt 13 for transmitting the motive force of the carriage motor 12 and moving the carriage 30 back and forth.

The two guide rails 11 are arranged at the top and the bottom and extend along the carriage movement direction with a certain spacing in the carrying direction between them, and are supported at their left and right ends by a frame (not shown in the drawings) serving as a base. The two guide rails 11 are arranged such that the lower guide rail 11*b* is located further to the front than the upper guide rail 11*a*. For this reason, the carriage 30, which spans the two guide rails 11*a* and 11*b*, moves in a tilted orientation in which its upper section is arranged to the rear.

The drive belt 13, which is band-shaped and made of metal, is spanned over two pulleys 44*a* and 44*b*, which are disposed at a spacing that is substantially the same as the length of the guide rails 11*a* and 11*b*, at an intermediate position between the upper and lower guide rails 11*a* and 11*b*. Of these pulleys 44*a* and 44*b*, one pulley 44*b* is fixed to a shaft of the carriage motor 12. The drive belt 13 is fixed to the left edge and the right edge of the carriage 30.

The carriage 30 is provided with twenty print heads 28 for ejecting ink of a plurality of colors. Each print head 28 has nozzle rows serving as ink ejecting sections, in each of which a plurality of nozzles n ejecting ink of the same color are arranged in a row. Ink is ejected from predetermined nozzles n under the control of a later-described drive controller 330 (see FIG. 7). The arrangement of the print heads 28 and the nozzles n will be discussed in greater detail later. Moreover, a plurality of sub-tanks 3 for temporarily storing the ink that is to be ejected by the twenty print heads 28 are mounted on the carriage 30. A main tank 9 for supplying ink to the sub-tanks 3 is provided outside of the movement range in the carriage movement direction of the carriage 30.

Moreover, the carriage 30 is provided with sub-tank plates 30A and 30B arranged in two levels, as shown in FIG. 3. The plurality of sub-tanks 3 are respectively mounted on these sub-tank plates 30A and 30B. The sub-tanks 3 are respectively connected via valves 4 to the print heads 28. Moreover, the sub-tanks 3 are connected by an ink supply duct 14 (see FIG. 2) to the main tank 9. The main tank 9 stores six types of inks that can be ejected by the print heads 28: black K, cyan C, light cyan LC, magenta M, light magenta LM and yellow Y.

In this embodiment, sub-tanks 3*a* to 3*f* for the inks in the six colors black K, cyan C, light cyan LC, magenta M, light magenta LM and yellow Y are provided. These six sub-tanks 3*a* to 3*f* are respectively connected to six corresponding main tanks 9*a* to 9*f*. It should be noted however, that the inks to be used are not limited to six colors, and it is also possible to use, for example, four colors of inks (for example black K, cyan C, magenta M and yellow Y) or seven colors of inks (for example black K, light black LK, cyan C, light cyan LC, magenta M, light magenta LM and yellow Y), without being limited to the above-described example.

The printer 20 prints on print paper P that is carried by the print paper carry section 21 by pulling the carriage 30 with the drive belt 13, which is driven by the carriage motor 12, moving the carriage 30 in the carriage movement direction along the guide rails 11, and ejecting ink from the twenty print heads 28 with which the carriage 30 is provided.

===Arrangement of Nozzles and Print Heads===

Figure 4:
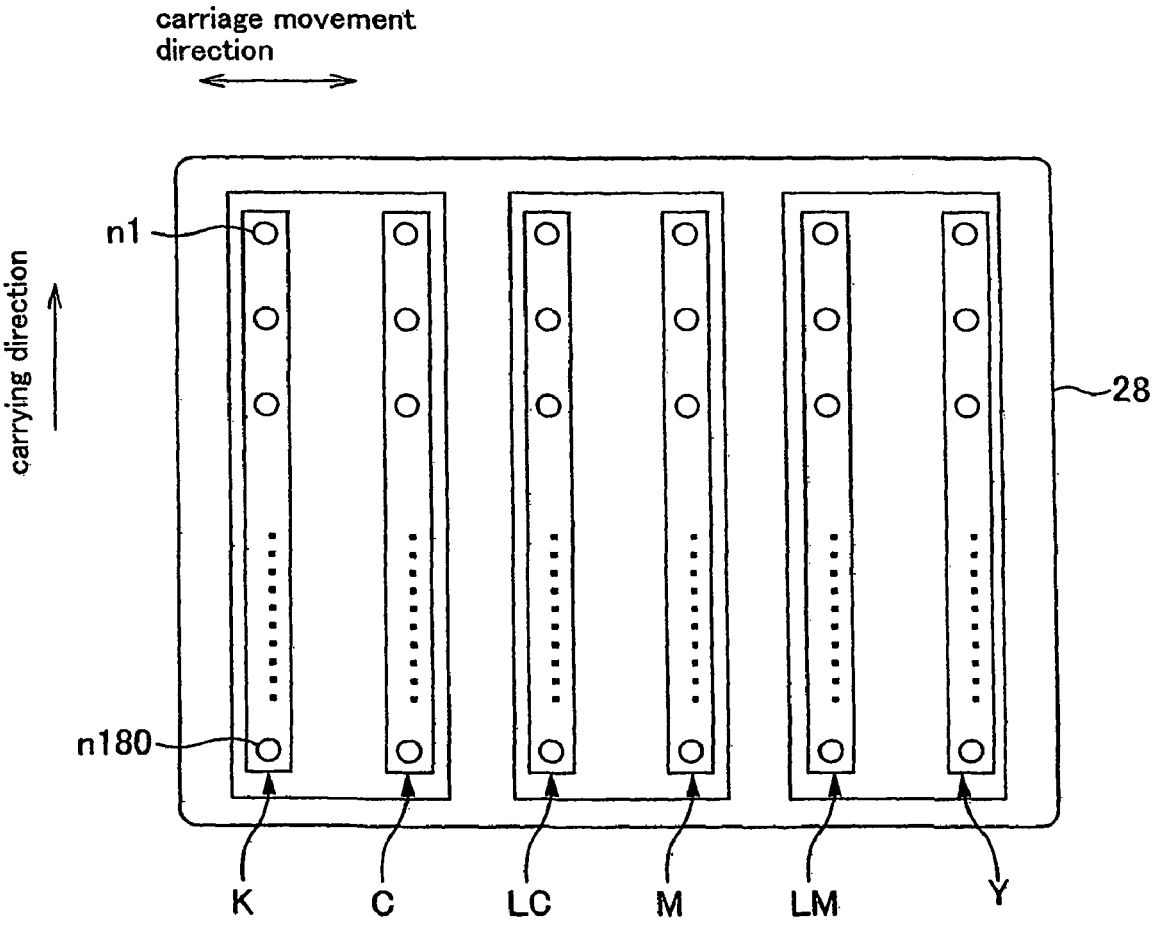
FIG. 4 is a diagram for explaining the arrangement of nozzles on a lower face of a single print head.

FIG. 4 is a diagram illustrating the nozzle arrangement on the bottom surface of one print head 28. Nozzle rows, in which 180 nozzles n are arranged in rows in the carrying direction of the print paper P, are arranged on the lower surface of the print head 28, with one nozzle row for each of the ejected ink colors. The nozzle rows of the various ink colors, that is, a black nozzle row K, a cyan nozzle row C, a light cyan nozzle row LC, a magenta nozzle row M, a light magenta nozzle row LM and a yellow nozzle row Y, are arranged next to one another at a certain spacing in the direction along the guide rails 11. The nozzles n are provided with a piezo element as a drive element for ejecting ink from each of the nozzles n.

Figure 5:
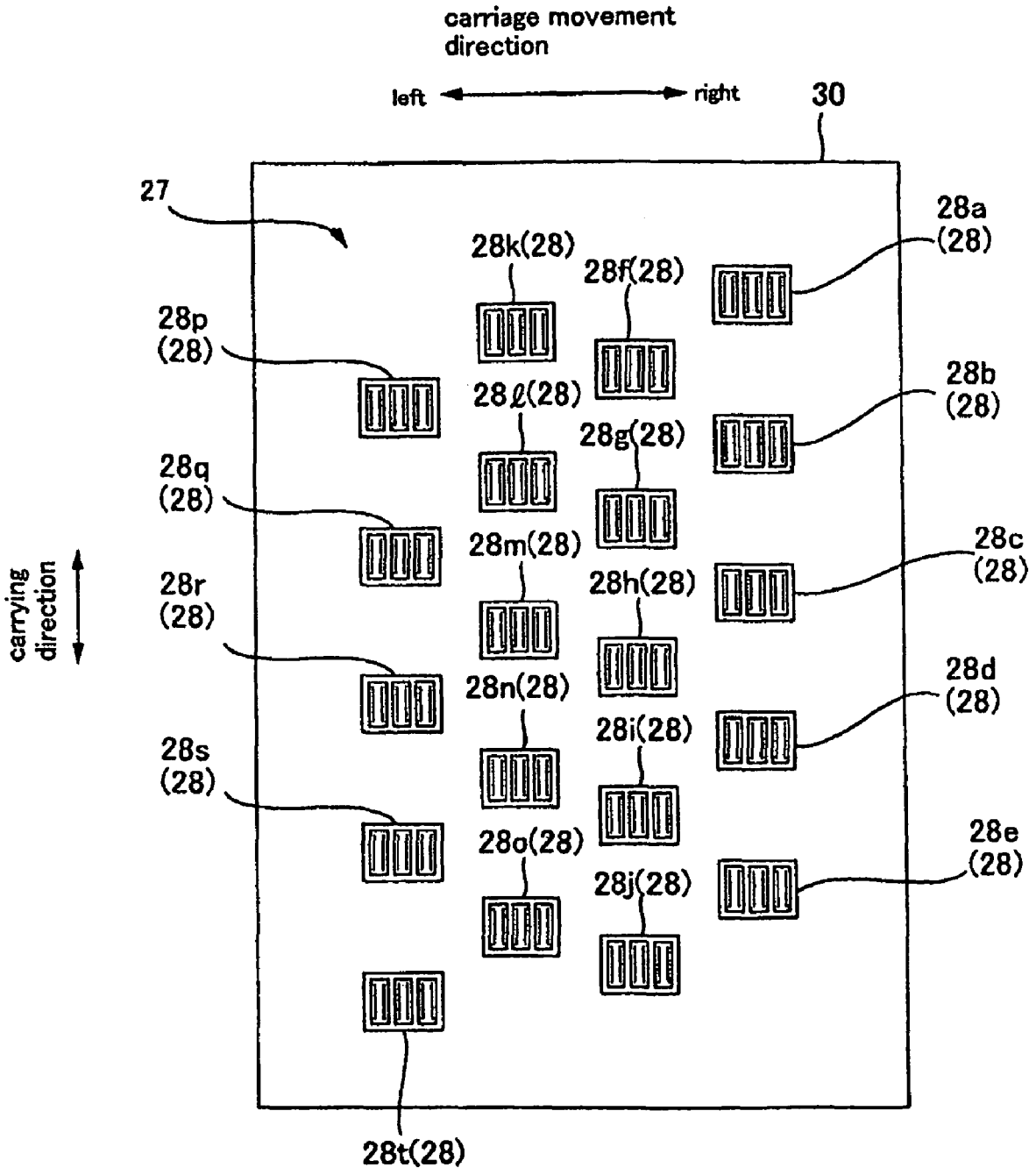
FIG. 5 is a diagram of a carriage seen from the direction of arrow A (FIG. 3).

FIG. 5 is a diagram showing the carriage 30 as viewed from the direction of arrow A (see FIG. 3). Needless to say, left and right in FIG. 5 are opposite from left and right in FIG. 1. The carriage 30 is provided with a print head group 27 that is constituted by the twenty print heads 28*a*, 28*b*, . . . , 28*t*. The twenty print heads 28 are disposed in four rows arranged in the carriage movement direction. Each of those print-head rows contains five print heads arranged at a certain interval in the carrying direction of the print paper P.

As shown in FIG. 5, of the four print heads 28*a*, 28*f*, 28*k* and 28*p* positioned at the uppermost position in each of the print-head rows, the print head 28*a* located furthest to the right in FIG. 5 is positioned furthest upward, the print head 28*k* at the uppermost position in the third row from the right is positioned second from the top, the print head 28*f* at the uppermost position in the second row from the right is positioned third from the top, and the print head 28*p* at the uppermost position in the leftmost row is positioned fourth from the top.

Figure 6:
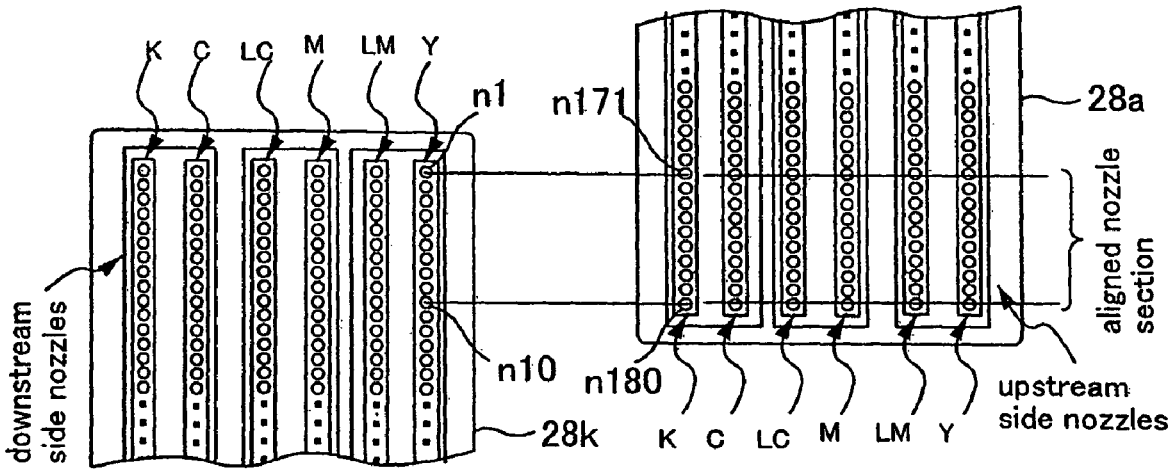
FIG. 6 is a diagram for explaining the arrangement of nozzle rows of print heads that are adjacent to one another in a carrying direction.

FIG. 6 is a diagram for explaining the arrangement of the nozzle rows that are contained in the print heads that are adjacent to one another in the carrying direction.

As illustrated, in the 20 print heads that are arranged in the carrying direction of the print paper P, the 180 nozzles n, for example, that are contained in each of the two print heads adjacent to one another in the carrying direction are arranged such that ten nozzles n in each print head are aligned in the movement direction of the carriage 30, if the print heads are ideally manufactured and attached. In FIG. 6, the print head 28*a* that is in the uppermost position is the print head that is positioned on the most downstream side in the carrying direction, and the print head 28*t* that is in the lowermost position is the print head that is positioned on the most upstream side in the carrying direction. In each of the two print heads that are adjacent in the carrying direction, the ten upstream-side nozzles n, serving as upstream-side ejection sections, that are positioned on the upstream side of the nozzle rows provided in one print head, which is positioned on the downstream side in the carrying direction, and the ten downstream-side nozzles n, serving as downstream-side ejection sections, that are positioned on the downstream side of the nozzle rows provided in the other print head, which is positioned on the upstream side in the carrying direction, are aligned in the movement direction of the carriage 30. For example, the ten upstream-side nozzles positioned on the upstream side of the print head 28*a*, which is positioned on the most downstream side, and the ten downstream-side nozzles positioned on the downstream side of the print head 28*k*, which is positioned second from the top, are aligned in the movement direction of the carriage 30. Below, the ten upstream-side nozzles positioned on the upstream side of the print head that is positioned on the downstream side and the ten downstream-side nozzles positioned on the downstream side of the print head 28 that is positioned on the upstream side of each pair of print heads 28 that are adjacent to one another in the carrying direction, such as the print head 28*k* that is second from the top and the print head 28*f* that is third, or the print head 28*f* that is third and the print head 28*p* that is fourth, are also aligned in the movement direction of the carriage 30.

Sections in which nozzles n of different print heads 28 adjacent to one another are aligned in the movement direction of the carriage 30, as described above, are referred to below as aligned nozzle sections (aligned ejection sections). Furthermore, in the description below, sections in which nozzles n that eject ink droplets of the same color and that are provided in different print heads 28 adjacent to one another are aligned in the movement direction of the carriage 30 are also referred to as aligned nozzle sections (aligned ejection sections).

===Print Paper Carry Section===

The print paper carry section 21 for carrying the print paper P is provided on the rear side of the two guide rails 11. Also, the print paper carry section 21 has a paper holding section 15 for rotatably holding the print paper P below the lower guide rail 11*b*, a paper carry holder 16 for carrying the print paper P above the upper guide rail 11, and a platen 17 that guides the print paper P that is carried between the paper holding section 15 and the paper carry holder 16.

The platen 17 has a flat surface spanning the entire width of the carried print paper P. Moreover, this flat surface functions as a support surface by which the print paper P that is carried in the carrying direction is supported in the carrying direction.

The paper holding section 15 is provided with a holder 15*a* for rotatably holding the print paper P. The holder 15*a* has a shaft member 15*b* serving as a rotation shaft that rotates with the print paper P in a held state, and guide disks 15*c* for keeping the supplied print paper P from zigzagging or tilting are provided on both ends of the shaft member 15*b*.

The paper carry holder 16 is provided with a carry roller 16*a* for carrying the print paper P, sandwiching rollers 16*b* that are provided in opposition to the carry roller 16*a* and that sandwich the print paper P between the carry roller 16*a* and themselves, and a carry motor 18 for rotating the carry roller 16*a*. A drive gear 18*a* is provided on the shaft of the carry motor 18, and a relay gear 18*b* that meshes with the drive gear 18 is provided on the shaft of the carry roller 16*a*. The motive force of the carry motor 18 is transmitted to the carry roller 16*a* via the drive gear 18*a* and the relay gear 18*b*. That is to say, the print paper P that is held by the holder 15*a* is sandwiched between the carry roller 16*a* and the sandwiching rollers 16*b* and is carried along the platen 17 by the carry motor 18.

===Controller of the Printer===

Figure 7:
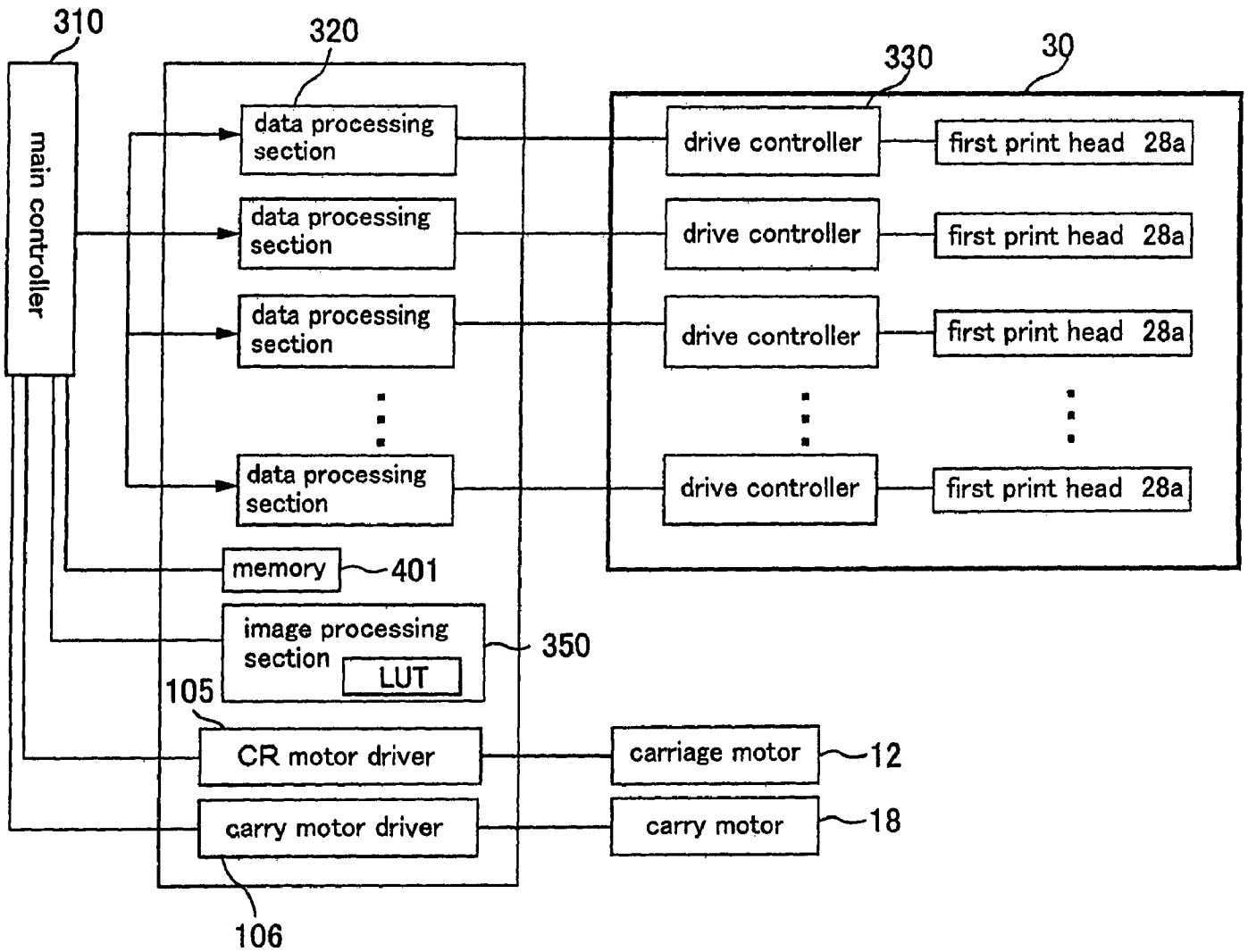
FIG. 7 is a block diagram showing the electrical configuration of the printer.

FIG. 7 is a block diagram showing the electrical configuration of the printer.

The printer 20 is provided with, for example, one main controller 310, a plurality of data processing sections 320 respectively corresponding to the plurality of print heads 28 on the carriage 30, an image processing section 350 for converting image data, which has been input from a computer connected to the printer 20, into print data that can be printed by the printer 20, a CR motor driver 105 for driving the carriage motor 12, a carry motor driver 106 for driving the carry motor 18, and a memory 401.

Each of the print heads 28 on the carriage 30 is made into a unit with a corresponding drive controller 330. Furthermore, the printer 20 is provided with the data processing sections 320 that correspond to the drive controllers 330, and each drive controller 330 and the corresponding data processing section 320 are connected by one flexible cable.

The main controller 310, which serves as the controller, is a control circuit for controlling the whole printer, and is configured so as to be capable of accessing the memory 401 that serves as a memory section storing, for example, nozzle alignment information that indicates the number of nozzles n that are aligned in the movement direction of the carriage 30 on the print heads 28 adjacent to one another in the carrying direction, and print information for executing printing with the aligned nozzle sections. The nozzle alignment information and print information are described below.

The data processing sections 320 are control circuits for performing bidirectional communication between the printer 20 and the carriage 30. The drive controllers 330 are control circuits for controlling the print heads 28 such that they eject ink as described above and for performing bidirectional communication with the data controller 320.

The image processing section 350 has a resolution converting section, a color converting section, a halftone processing section, a rasterizing processing section and a color conversion lookup table LUT.

===Overview of Image Processing===

The printer 20 converts, using the image processing section 350, image data provided from, for example, a host computer connected to the printer 20 into print data for printing with the printer 20.

Figure 8:
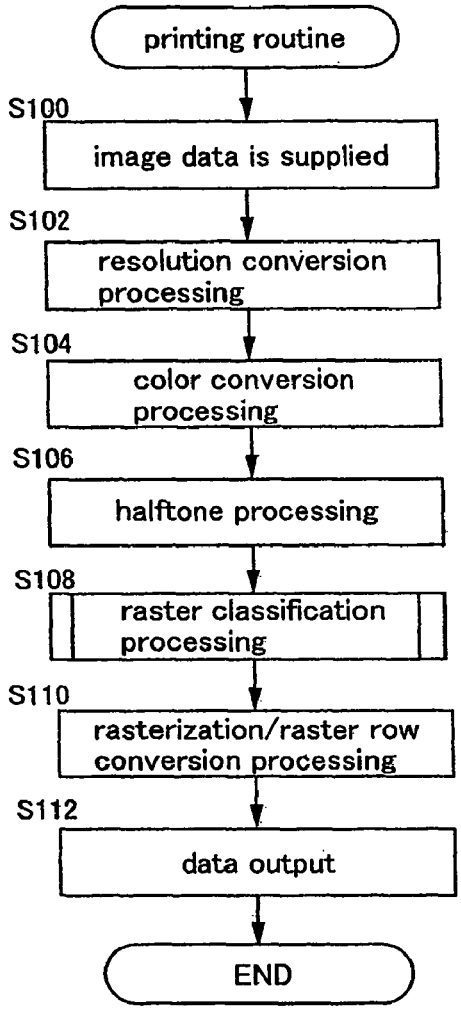
FIG. 8 is a flowchart showing an overview of image processing executed in an image processing section.

FIG. 8 is a flowchart showing an overview of the image processing executed by the image processing section.

Image data is supplied to the image processing section 350 from the host computer, for example (step S100). The data is supplied from an application program, for example, and has 256 gradations represented by the values 0 to 255 for the respective colors R (red), G (green) and B (blue) for each pixel that constitutes the image.

The resolution of the supplied RGB image data is converted by the resolution converting section of the image processing section 350 into the printing resolution for printing by the printer 20 (step S102). The image data whose resolution has been converted is image information that is still made of the three RGB color components.

The color converting section processes the image data whose resolution has been converted, and referring to the color conversion lookup table LUT, converts the RGB image data pixel by pixel into multi-gradation data for each ink color corresponding to the plurality of ink colors that are usable by the printer 20 (step S104). The multi-gradation data that has been color converted has graduated values of, for example, 256 gradations.

The multi-gradation data that has been color converted for each ink color is converted into binary image data that expresses halftone images in binary data by executing so-called halftone processing such as dithering in the halftone processing section (step S106). The binary image data is expressed by the presence or absence of dots.

The binary image data that has been converted is rearranged by the rasterizing processing section and a raster-row conversion processing section in the order of data that should be forwarded to the printer 20. At this time, the binary image data is rearranged, by the rasterizing processing section and the raster-row conversion processing section, in the order of data to be forwarded to the printer 20 in accordance with the ink-droplet-ejecting method for performing printing using aligned nozzle sections in which the nozzles for ejecting ink droplets of the same color that are provided on adjacent different print heads 28 are aligned in the movement direction of the carriage 30.

Rearrangement of the data order is executed first from raster classification (step S108). Raster classification is a process of classifying, raster by raster, which rasters, which constitute the image data, are to be formed by which nozzle row on which print head 28 in which pass in the movement of the carriage 30. In the printer 20 of the present embodiment, the rasters formed by the aligned nozzle section are selected through raster classification, and the selected rasters are controlled so that the dots are formed by an ink-droplet-ejecting method that has been set in advance. Here, a "raster" refers to a region corresponding to a single line in the movement direction of the carriage 30 that can be formed by ink droplets ejected from a single nozzle n while moving the carriage 30, or to a row of dots formed in this way. The raster classification processing, the ink-droplet-ejecting method for the aligned nozzle sections, and the method for setting the same are described further below.

When raster classification is completed, rearrangement of the binary data into the order for transfer to the printer 20 is executed by the rasterizing processing section and the raster-row conversion processing section (step S110). The print data that has been rearranged is output to the print heads 28 (step S112), and an image is printed on print paper by forming dots in accordance with the supplied print data.

===Method for Ejecting Ink Droplets with the Aligned Nozzle Sections===

Figure 9:
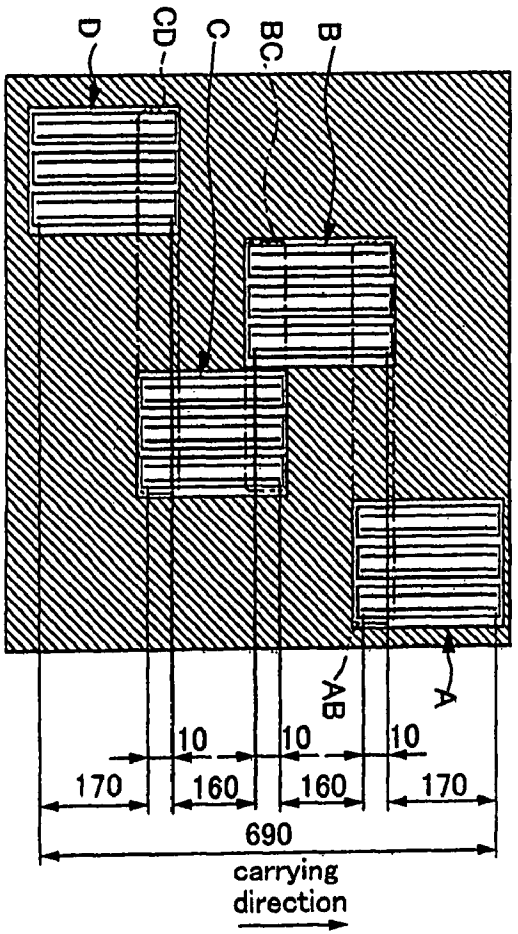
FIG. 9 is a diagram that schematically shows the number of rasters formed when the carriage moves, and their positional relationship.

FIG. 9 is a diagram schematically showing the number of rasters formed when the carriage moves, and their positional relationships. In order to simplify the description here, the present embodiment is described with four print heads A to D. Furthermore, each print head 28 has six nozzle rows that separately eject six colors of ink, and 180 nozzles n are provided in each nozzle row. The numbers in the diagram illustrate the numbers of the rasters that are formed by the corresponding section. If the printer 20 is manufactured and assembled as designed, then, as regards the nozzle rows of print heads that are adjacent to one another in the carrying direction, ten nozzles n positioned on the downstream side of the nozzle rows on the print head that is positioned on the upstream side in the carrying direction and ten nozzles n positioned on the upstream side of the nozzle rows on the print head that is positioned on the downstream side are aligned in the movement direction of the carriage 30.

Color images are printed by layering single-color images that are formed individually by inks of a plurality of colors. The following is an explanation of a method for ejecting ink droplets using aligned nozzle sections of nozzle rows that eject ink droplets of the same color, such as two cyan nozzle rows C that eject cyan ink droplets, and that are provided in different print heads adjacent to one another, because when printing a single image using a plurality of print heads, a single-color image is printed by nozzle rows that eject ink droplets of the same color and that are provided on different print heads.

When ejecting ink droplets while moving the carriage 30, 170 rasters are formed by the 170 nozzles n in the independently-operating section of the cyan nozzle row C, excluding the 10 upstream nozzles of the 180 nozzles n that are included in the cyan nozzle row C that ejects cyan ink droplets on the print head A. In the aligned nozzle section AB of the cyan nozzle row C of the print head A and the cyan nozzle row C of the print head B, 10 rasters are formed according to an ink-droplet-ejecting method in which the nozzles that actually eject the ink droplets are appropriately switched among the nozzles n that are lined up in the movement direction of the carriage 30 in the aligned nozzle section. Since the cyan nozzle row C of the print head B overlaps with the cyan nozzle row C of the print head A and the cyan nozzle row C of the print head C at both ends, 160 rasters are formed by the independently-operating section of the cyan nozzle row C of the print head B. Similarly, 160 rasters are formed by the independently-operating section of the cyan nozzle row C of the print head C, 170 rasters are formed in the independently-operating section of the cyan nozzle row C of the print head D, and 10 rasters are formed in each of the aligned nozzle sections BC and CD.

In FIG. 9, the four print heads each containing 180 nozzles n are arranged as noted above, and thus the carriage 30 functions as a large print head on which 690 nozzles n are provided.

Figure 10:
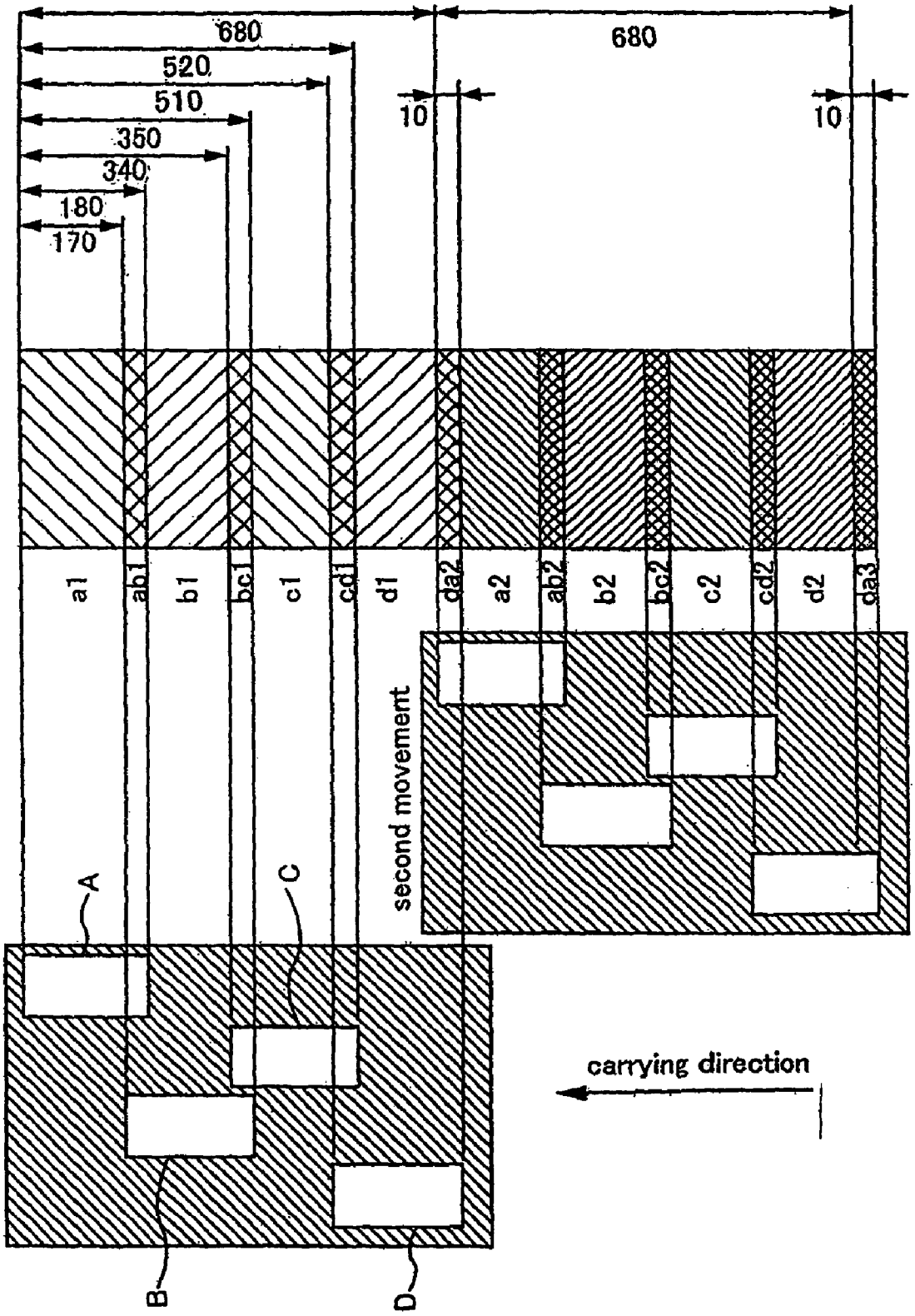
FIG. 10 is an explanatory diagram that conceptually represents how rasters are formed while the print paper is carried.

FIG. 10 is an explanatory diagram conceptually showing how rasters are formed while the print paper is carried. The positions of the print heads before and after carrying the print paper are shown on the left side of FIG. 10, and a region formed by a raster group when the carriage 30 is moved is schematically shown by hatching on the right side of the respective print heads.

Regions in which the print heads A to D each independently form rasters, and regions between those regions in which two print heads form rasters in an overlapping manner, appear every time the carriage 30 is moved. In the diagram, a region indicated as "a1" is a region in which rasters are formed by the independently-operating section of the print head A in the first pass, and the region indicated as "b1" is a region in which rasters are formed by the independently-operating section of the print head B in the first pass. Furthermore, the region indicated as "ab1" shows a region in which rasters are formed using the aligned nozzle section AB of two print heads, the print head A and the print head B, in the first pass.

Furthermore, in the joint region between a region formed by the print head D during the first pass of the carriage 30 and a region formed by the print head A during the second pass, rasters are formed using the upstream-side nozzles of the print head D and the downstream-side nozzles of the print head A, so that the joint region does not stand out and cause deterioration in print quality. That is to say, as shown in FIG. 9, the carriage functions as a large head on which 690 nozzles n are provided, but the amount that the print paper is carried per single carry is equivalent to 680 rasters so that the 10 nozzles on the upstream side of the print head D during movement of the first pass of the carriage overlap with the 10 downstream-side nozzles of the print head A during the second pass of the carriage. In the diagram, the region indicated by "da2" shows this region in which rasters are formed using two print heads, namely the print head D during the first pass and the print head A during the second pass.

If the print heads etc. of the printer 20 of the present embodiment are ideally manufactured and assembled, then rasters are formed by carrying the print paper by an amount equivalent to 680 rasters each time the carriage 30 is moved. As a result, as shown in FIG. 10, regions in which the print heads A, B, C and D individually form rasters with their independently-operating sections, and regions between those regions and in which rasters are formed using the aligned nozzle section of two print heads are repeatedly formed at a period of 680 rasters. Consequently, in order to print an image, it is necessary that the binary data, which has been converted to express the presence or absence of dots through the image processing in FIG. 8 (step S102 to step S112), is supplied to the respective print head at an appropriate timing while matching it to the positions in the movement direction of the carriage.

The description up to now has been of printers in which print heads etc. have been ideally manufactured and assembled; however, when a plurality of print heads are attached onto a single carriage, it is not necessarily the case that the print heads are ideally attached. For example, there are cases in which some of heads of the plurality of heads are attached in a tilted manner, for example.

Figure 11:
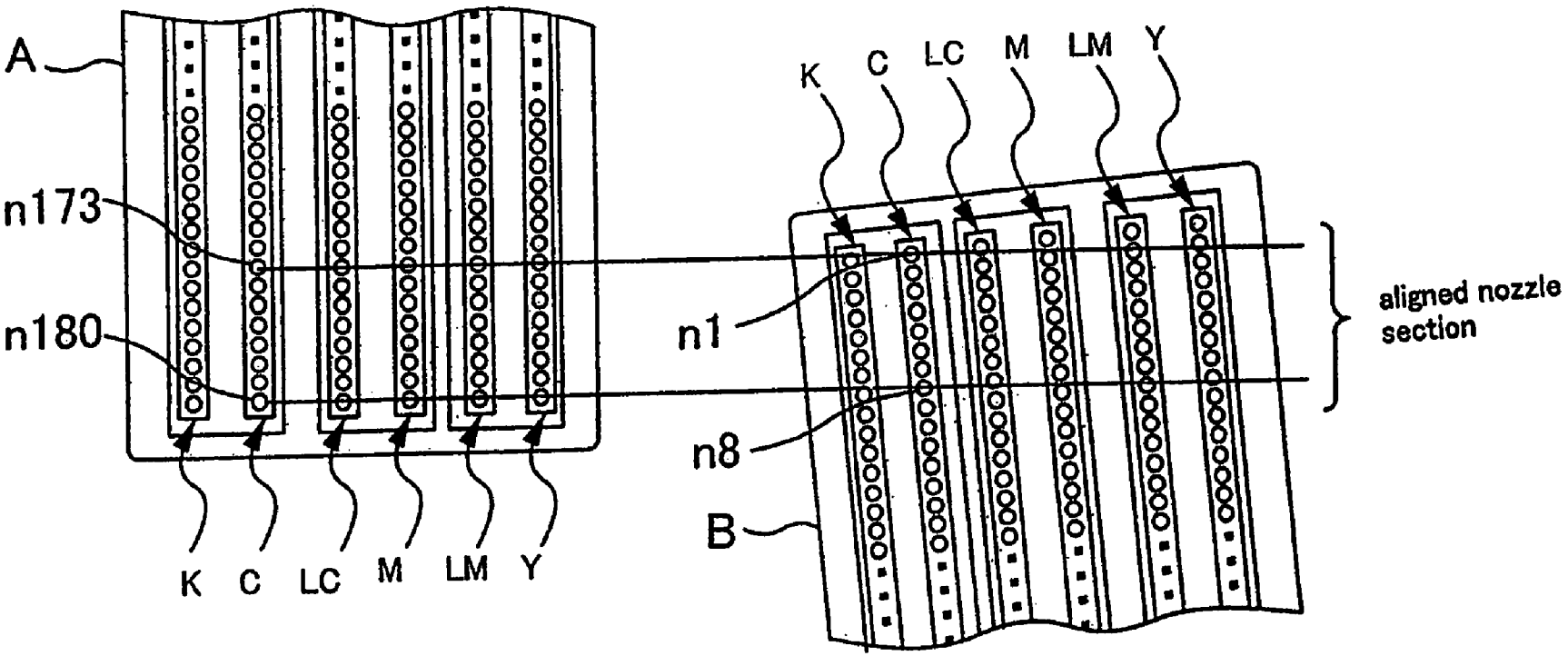
FIG. 11 is a diagram for explaining an aligned nozzle section when one print head, of the two print heads that are adjacent in the carrying direction, is attached in a tilted manner.

FIG. 11 is a diagram for explaining the aligned nozzle section in the case when of one of two print heads that are adjacent in the carrying direction is attached in a tilted manner. In FIG. 11, the print head A is ideally attached, and the print head B is attached in a tilted manner. Thus, in the nozzle rows for ejecting ink droplets of the same color on two print heads that are adjacent in the carrying direction, the number of nozzles that are aligned in the movement direction of the carriage, that is to say, the number of nozzles n that are aligned in the aligned nozzle section, may differ for each nozzle row. Thus, in the printer of the present embodiment, the number of nozzles n that are aligned in the aligned nozzle sections of the nozzle rows of each color is confirmed in advance in the manufacturing process, for example, and stored in the memory 401 of the controller in association with the aligned nozzle section of the nozzle row for each color.

Figures 12, 13:
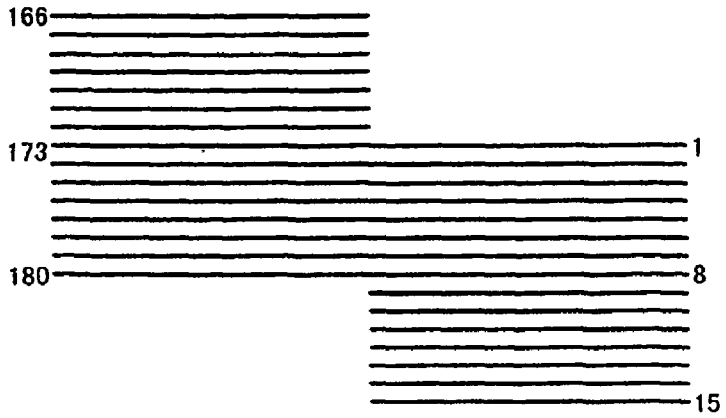
FIG. 12 is a diagram for explaining a print pattern for confirming the number of nozzles that are aligned in the aligned nozzle section.
FIG. 13 is a conceptual diagram showing the number of nozzles aligned in the aligned nozzle section that are stored in a memory.

Confirmation of the number of nozzles n that are aligned in the aligned nozzle section is performed, for example, by observing a print pattern formed by actually ejecting ink droplets from the nozzle rows. FIG. 12 is a diagram illustrating a print pattern for confirming the number of nozzles n that are aligned in the aligned nozzle section. This print pattern is a pattern that is printed using 15 nozzles n that include upstream-side nozzles of the print head A, which is on the downstream side in the carrying direction of among two print heads that are adjacent to one another in the carrying direction, and 15 nozzles n that include downstream-side nozzles of the print head B. which is on the upstream side, and is a pattern in which 15 lines are formed by each print head by making each of the print heads eject ink droplets at a different timing while moving the carriage 30 for approximately 20 mm. For the sake of illustration, the numbers at the side of the lines in the diagram indicate the numbers of the nozzles that ejected the ink droplets for forming the lines, but they are not actually printed. In the example of FIG. 12, it is confirmed that eight nozzles n are aligned in the aligned nozzle section, and information that indicates the number of aligned nozzles is stored in the memory section 401 in correlation to the aligned nozzle section included in the nozzles that printed this pattern.

FIG. 13 is a conceptual diagram showing the numbers of nozzles aligned in the aligned nozzle sections that are stored in the memory. FIG. 13 is an example in which four print heads are mounted on the above-noted carriage, and it shows the case in which the print head B is attached in a tilted manner. As illustrated, the aligned nozzle sections are stored associated with the colors of the ejected ink, that is to say, the nozzle rows. FIG. 13 shows the case in which the print head B is attached in a tilted manner, but there are also cases in which the print head B is not attached in a tilted manner, but is attached, for example, in a position that is shifted in the carrying direction. In this case, the number of nozzles n that are aligned in the aligned nozzle section will be the same for all nozzle rows. That is to say, if the print head B is attached with a shift to the downstream side in the carrying direction, then for the number of nozzles that are aligned in an aligned nozzle section AB, a value larger than "10", such as "11" or "12" or the like is recorded for each nozzle row, and if the print head is attached shifted to the upstream side in the carrying direction, then for the number of nozzles that are aligned in the aligned nozzle section AB, a value smaller than "10", such as "8" or "9" is recorded for each nozzle row.

Thus, in the raster classification processing (step S108) of FIG. 8, first of all, information representing the number of nozzles n that are aligned in the aligned nozzle sections, which is stored in the memory 401, is obtained, and for each of the rasters that constitute the binary data after image processing, the head to which the print data is supplied, and the timing and the pass at which the print data is supplied are determined in the following way based on the obtained information.

===Raster Classification Processing===

Figure 14:
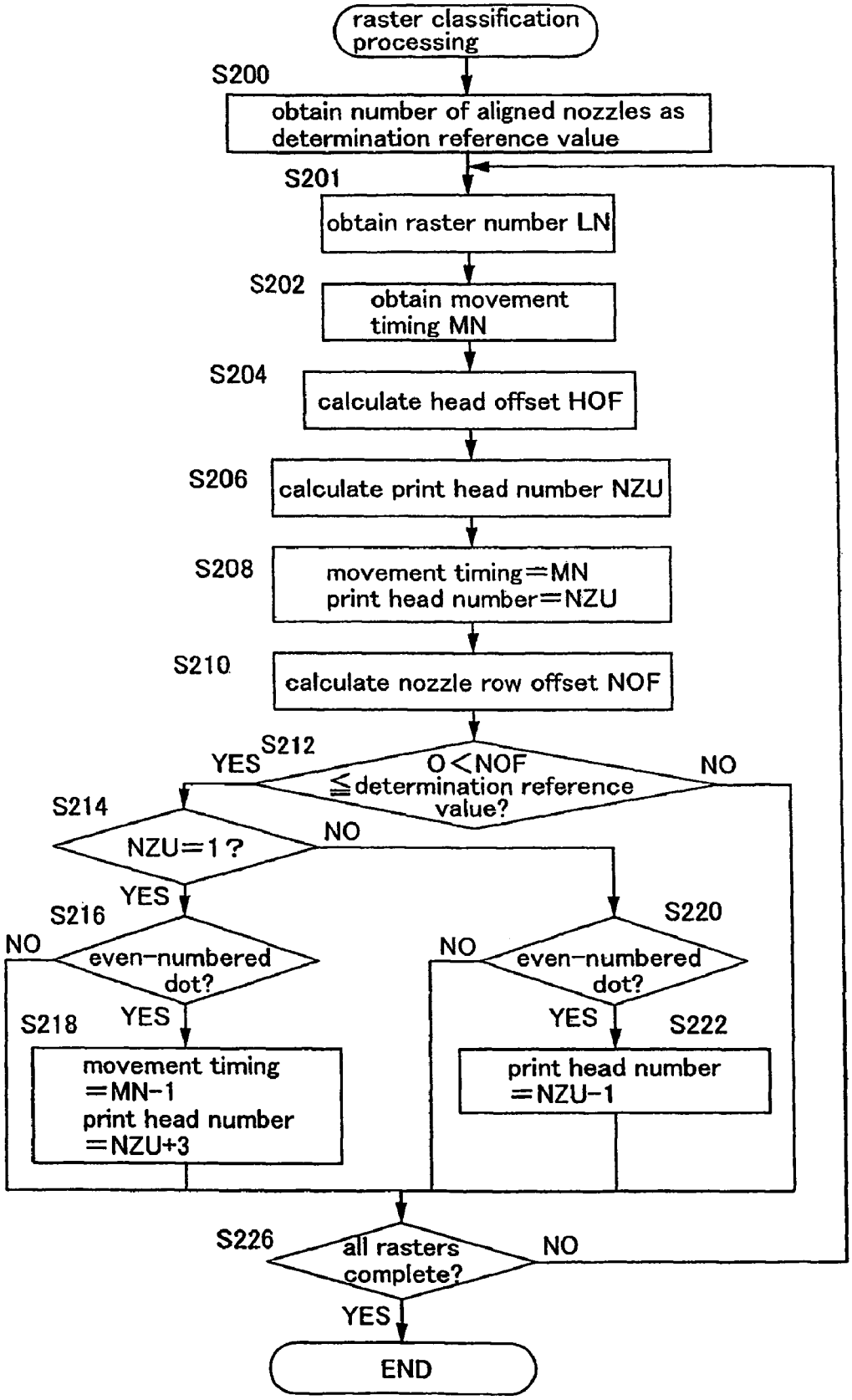
FIG. 14 is a flowchart showing the flow of raster classification.
Figure 15:
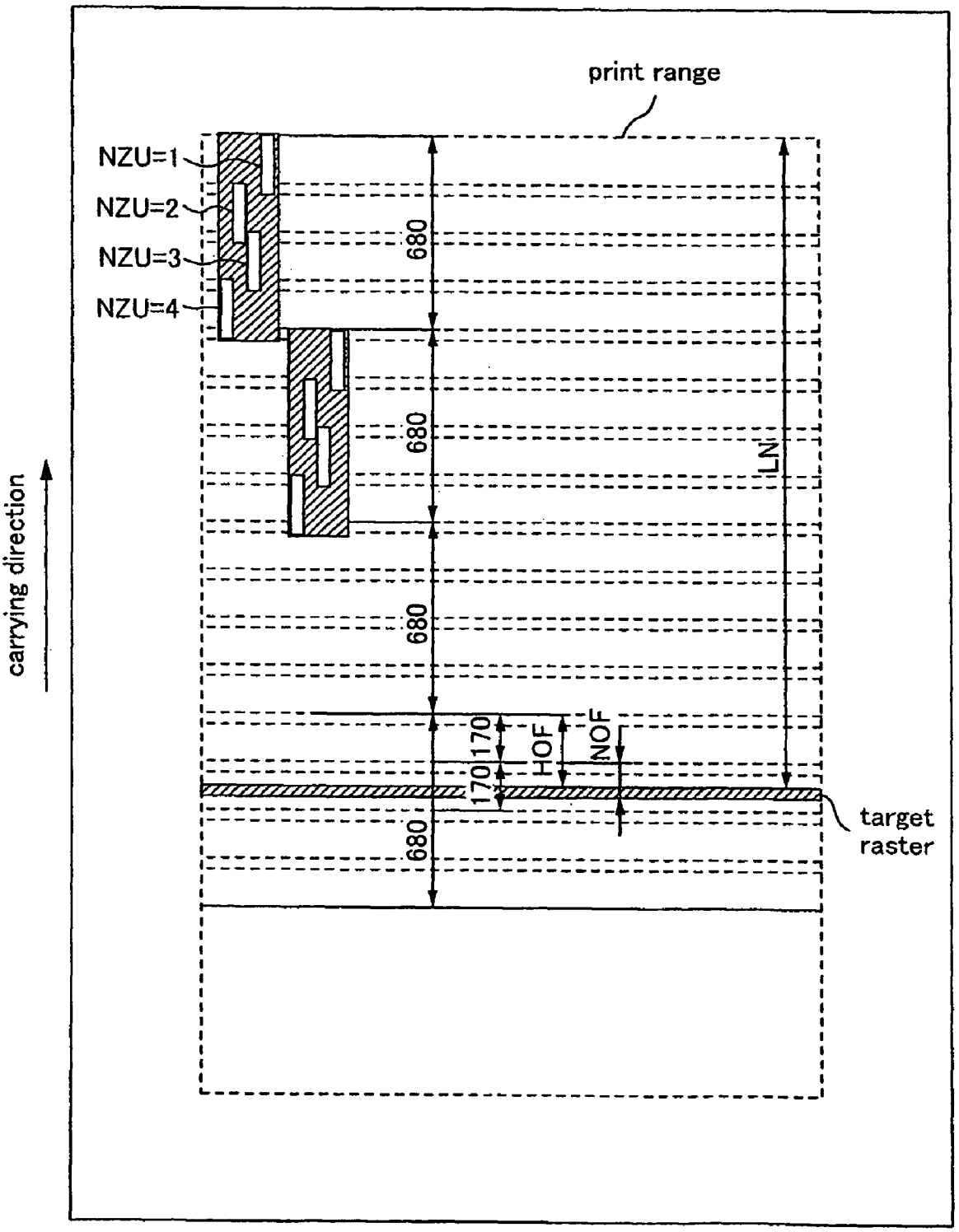
FIG. 15 is a diagram that conceptually represents how an image is formed on the print paper while moving the carriage.

FIG. 14 is a flowchart showing the flow of the raster classification, and FIG. 15 is a diagram conceptually showing how the carriage moves and forms an image on the print paper. The regions surrounded by the dashed lines in FIG. 15 are the regions in which rasters are formed by the carriage. This example is also described with a carriage that has four print heads, as noted above, and the number of rasters that are formed with each single pass of the carriage is 680.

Below, raster classification that is executed by the printer 20 of the present embodiment is described with reference to FIG. 14 and FIG. 15. Raster classification is executed for each ejected ink color; however, the details of this process are the same for all the ink colors. Here, it is described for nozzles that eject cyan ink.

In raster classification, first, information representing the numbers of nozzles aligned in the aligned nozzle sections, which is stored in the memory 401, is obtained (step S200). Accordingly, in the example of FIG. 13, information indicating that the number of nozzles aligned in the aligned nozzle section AB is "7", the number of nozzles aligned in the aligned nozzle section BC is "13", the number of nozzles aligned in the aligned nozzle section CD is "10" and the number of nozzles aligned in the aligned nozzle section DA is "10" is obtained.

Next, a raster number LN of the raster that is targeted for determination (the target raster) is obtained (step S201). The raster number LN is a number that indicates the position of the raster in the print range, and as shown in FIG. 15, is a value that indicates what number the raster is from the top edge of the print region.

Next, the number of the carriage pass during which the target raster is to be formed, that is to say, the movement timing MN at which the target raster is formed is calculated (step S202). As shown in FIG. 15, since the print head forms 680 rasters on each pass, the movement timing MN at which the target raster is formed can be determined by the following expression:

$$MN=int(LN/680)+1 \quad (1)$$

where int(A) is an operator that outputs the integer part of A.

For example, when the raster number LN of the target raster is 170, expression (1) is $$MN=int(170/680)+1=0+1=1$$

and thus it can be found that the raster having raster number=170 is formed on the first pass of the carriage.

When the movement timing MN is calculated like this, the next step is to determine the print head that forms the target raster. Head offset HOF is calculated in preparation for this (step S204).

Head offset HOF is calculated using the following expression:

$$HOF=LN-680\times(MN-1) \quad (2)$$

As can be understood from the foregoing expression, head offset HOF is a value indicating the number of the target raster counted from the uppermost section of the carriage. In the example shown in FIG. 15, since the target raster is formed on the fourth pass, it follows from expression (2) that the target raster is formed as the raster with the number (LN−680×3).

When the head offset HOF has been determined, the print head number NZU that forms the target raster is calculated based on the head offset HOF (step S206). As shown in FIG. 15, numbers 1 to 4 are assigned in that order to the four print heads that constitute the carriage, and these numbers are the print head numbers. The print head number NZU is calculated using the following expression:

$$NZU=int(HOF/170)+1 \quad (3)$$

That is to say, since the carriage is constituted by four print heads having print head numbers 1 to 4, the 680 rasters that the carriage forms on one pass are divided equally into four, and it is possible to assume that each print head forms 170 rasters in each region. Of course, two print heads are used to form the rasters formed by the aligned nozzle sections of the print heads, and thus it is not possible to select the print head simply from the head offset HOF, but this may be corrected at a later stage.

When the movement timing MN and the print head number NZU of the target raster have been determined by performing the above-noted process, these are temporarily stored as the movement timing MN and the print head number NZU of the target raster (step S208), and the rasters corresponding to the aligned nozzle section of the print head are corrected in the following way.

As preparations for correcting the aligned nozzle section, first a nozzle row offset NOF of the target raster is calculated (step S210). The nozzle row offset NOF is a value as follows. As noted above, it may be considered that the 680 rasters formed on a single pass of the carriage is formed with 310 rasters by each of the four print heads; however, in a printer in which the print heads etc. are ideally manufactured and assembled, the top section of the nozzle rows, namely the ten rasters on the downstream side in the carrying direction, are formed, intermixed with dots formed by other print heads. Accordingly, it is necessary to know what number, counted from the downstream side of each nozzle row, the target raster corresponds to. The value that indicates what number from the downstream side of the nozzle rows the target raster corresponds to is called the nozzle row offset NOF.

NOF can be determined by the following expression.

$$NOF=HOF-int(HOF/170)\times170 \quad (4)$$

When the unit offset NOF is determined by expression (4), the procedure determines whether or not this value is less than or equal to 10 (step S212). That is to say, in a printer whose print heads etc. are ideally manufactured and assembled, rasters whose NOF value is 10 or greater are formed by a single print head, and thus there is no need to correct the selected print head. However, a raster whose NOF is 10 or less is formed using a plurality of print heads, and thus it is necessary to correct the print head that was previously selected. Accordingly, in step 212, the procedure determines whether or not the value of NOF is 10 or less. In other words, the determination reference value becomes the number of nozzles that are aligned in each aligned nozzle section.

For example, if the number of nozzles aligned in the aligned nozzle section is not "10", then for the nozzles that eject cyan ink, information regarding the aligned nozzles is obtained from the information shown in FIG. 13 that indicates that 7 nozzles are aligned in the aligned nozzle section AB, that 13 nozzles are aligned in the aligned nozzle section BC, that 10 nozzles are aligned in the aligned nozzle section CD, and that 10 nozzles are aligned in the aligned nozzle section DA, and the information indicating the number of nozzles obtained becomes the determination reference value.

If the value of the nozzle row offset NOF is determined to be equal to or less than the determination reference value, then the selected print head is corrected, but prior to that, the procedure determines whether or not the print head number NZU is 1 (step S214). This is due to the following reason. As shown in FIG. 15, the print head whose NZU is 1 forms rasters intermixed with the print head whose NZU is 4 of the previous pass of the carriage. Consequently, if NZU is number 1, then not just the selected print head, but also the movement timing must be corrected, and thus the procedure first determines whether or not the NZU is number 1. Furthermore, in step 212, if the value of the nozzle row offset NOF is determined to be greater than the determination reference value, then the movement timing MN and the print head number NZU that were determined in step S208 are employed.

As for correction of the selected print head, only the even numbered dots that constitute the target raster are corrected. In this way, the odd numbered dots are formed by the previously selected print head, and the even numbered dots are formed by the corrected print head, so that the dots are formed alternately by the two print heads. In the method described here, only the even numbered dots that constitute the target raster are corrected; however, this for the case in which an ink-droplet-ejecting method forming dots alternately using the upstream-side nozzles and the downstream-side nozzles of two print heads is set as the ink-droplet-ejecting method of that aligned nozzle section as described below, and if another ink-droplet-ejecting method is set, the correction is performed accordingly.

If the nozzle number NZU is determined to be number 1 in step S214, then the procedure determines, for all the dots that constitute the target raster, whether they are even numbered dots or not (step S216), and for the even-numbered dots, the procedure corrects the movement timing to a previous movement timing, and corrects the print head number from 1 to 4 (step S218). Odd-numbered dots are not corrected, and the values recorded in step S208 are employed.

If the nozzle number NZU in step S214 is not 1, the situation is substantially the same, and the procedure determines, for all the dots that constitute the target raster, whether they are even-numbered or not (step S220), and for the even-numbered dots, the print head number NZU is corrected so that it becomes the directly preceding print head number (step S222). Odd-numbered dots are not corrected, and the values recorded in step 208 are employed.

When the correction for the aligned nozzle sections of the print heads has been completed in the manner described above, the procedure determines whether or not processing of all the rasters is complete (step S226), and if unprocessed rasters remain, the procedure returns to step S201 and continues the processing. When the movement timing and print head have been determined for all the rasters, the raster classification processing is ended and the procedure returns to the printing routine of FIG. 8, and print data is output to each of the print heads at the timing determined by raster classification.

===Method for Ejecting Ink Droplets in the Aligned Nozzle Sections===

The ink-droplet-ejecting method when printing with a so-called band feed mode using the printer 20 is described. In the printer 20 of the present embodiment, the carriage is configured with 20 print heads, and 180 nozzles are provided in each print head; however, for illustrative reasons, the carriage is taken to be constituted by two print heads, and the number of nozzles per print head and the length of the aligned nozzle section of the print head are represented to be shorter than is actually the case.

<First Ink-Droplet-Ejecting Method>

Figure 16:
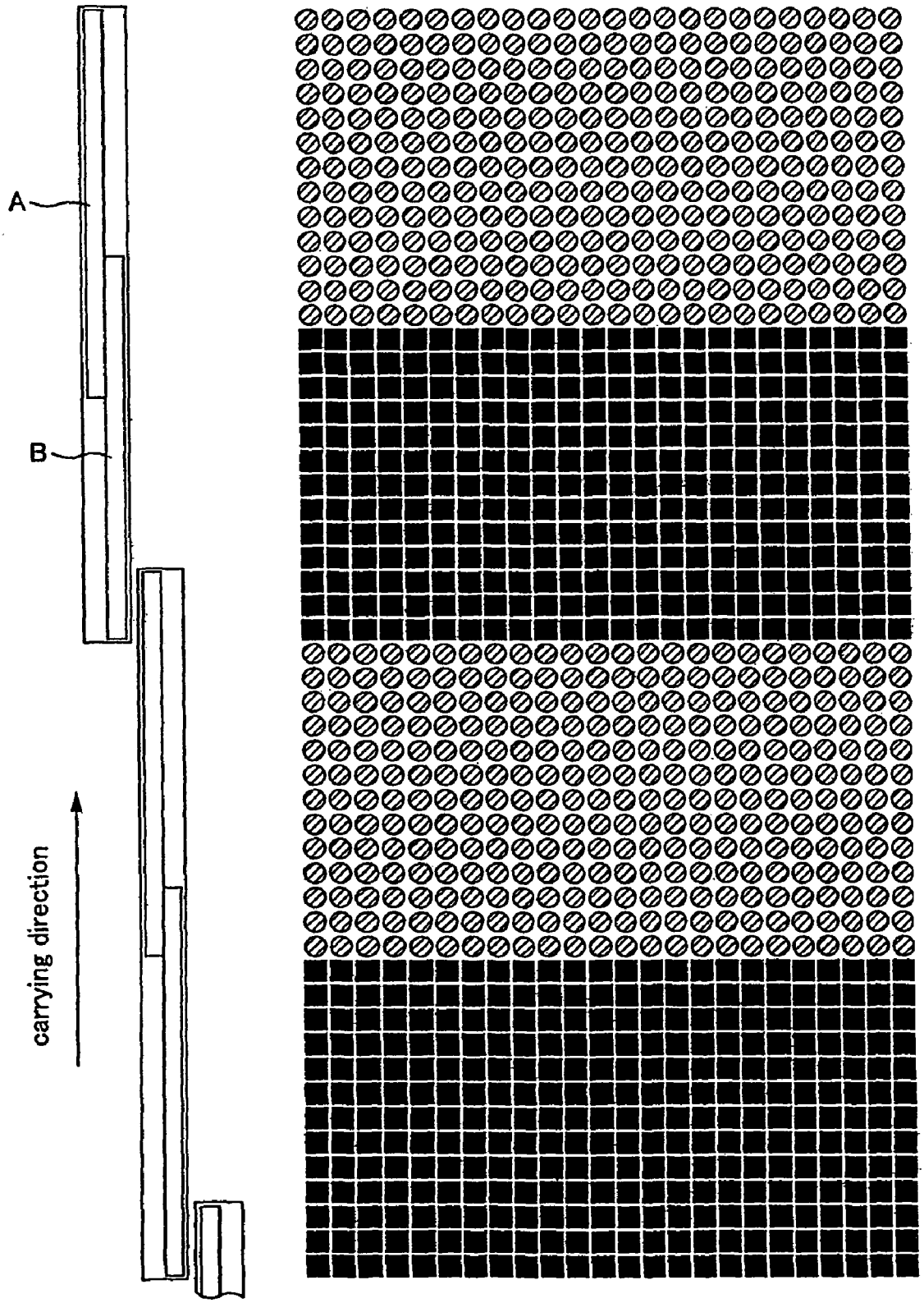
FIG. 16 is a diagram for describing an image printed using a first ink-droplet-ejecting method.

FIG. 16 is a diagram for explaining an image that is printed by a first ink-droplet-ejecting method.

As the first ink-droplet-ejecting method, an example is shown in which printing is performed using only the nozzles of either print head, from among the aligned nozzles of different print heads in the aligned nozzle sections of the print heads. In the case of FIG. 16, for a border section between the regions printed respectively by the print head A and the print head B, the ink droplets are ejected only from the nozzles of print head A that are provided in the aligned nozzle section. In the image printed by this ink ejecting method, the border between the regions printed by the respective print heads is clearly defined. Thus, on a carriage that is configured with a plurality of print heads, there are cases in which image quality degrades at the joint region if the ink ejecting characteristics differ slightly between print heads. Accordingly, if the aligned nozzle section of any of the print heads includes nozzles that have special ink ejecting characteristics or nozzles whose ink trajectory differs from that of other nozzles, then there are cases in which it is possible to obtain a better image by printing the border section using nozzles of another print head.

<Second Ink-Droplet-Ejecting Method>

Figure 17:
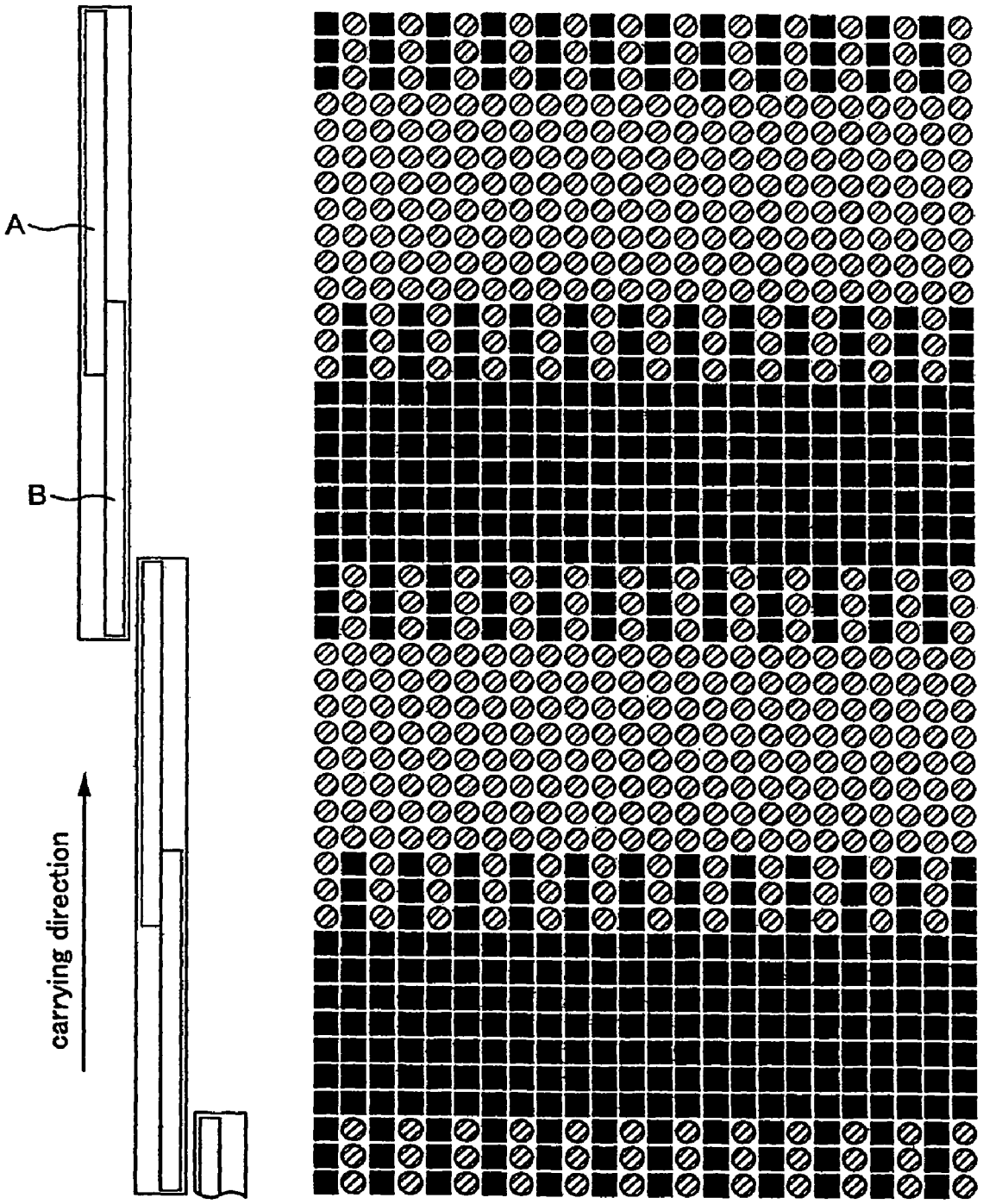
FIG. 17 is a diagram for describing an image printed using a second ink-droplet-ejecting method.

FIG. 17 is a diagram for explaining an image that is printed by a second ink-droplet-ejecting method.

In the second ink-droplet-ejecting method, the rasters printed by the aligned nozzle section of the print heads are formed by alternately selecting the aligned nozzles of either one of the different print heads, and alternately ejecting ink droplets to form dots. In this case, the dots that constitute a plurality of rasters printed with the aligned nozzle section and that are aligned in the carrying direction of the paper are printed by ejecting ink from nozzles provided on the same print head. That is to say, when a section that is printed by the aligned nozzle section is examined, dot rows that extend in the carrying direction and that are formed by the nozzles of different print heads, are arranged in alternation. When printing with the second ink-droplet-ejecting method, the border between the print regions is less noticeable than in the image printed according to the first ink-droplet-ejecting method. Consequently, even if the ink ejection characteristics differ slightly between adjacent print heads, the joint region between the regions printed by different print heads is less noticeable, and thus it is possible to suppress degradation of the image quality. However, dots formed by the same print head are aligned vertically in the aligned nozzle section of the print heads, and thus in these regions, characteristic periodic variations such as darkness variations in the image are noticeable, and image quality may drop.

<Third Ink-Droplet-Ejecting Method>

Figure 18:
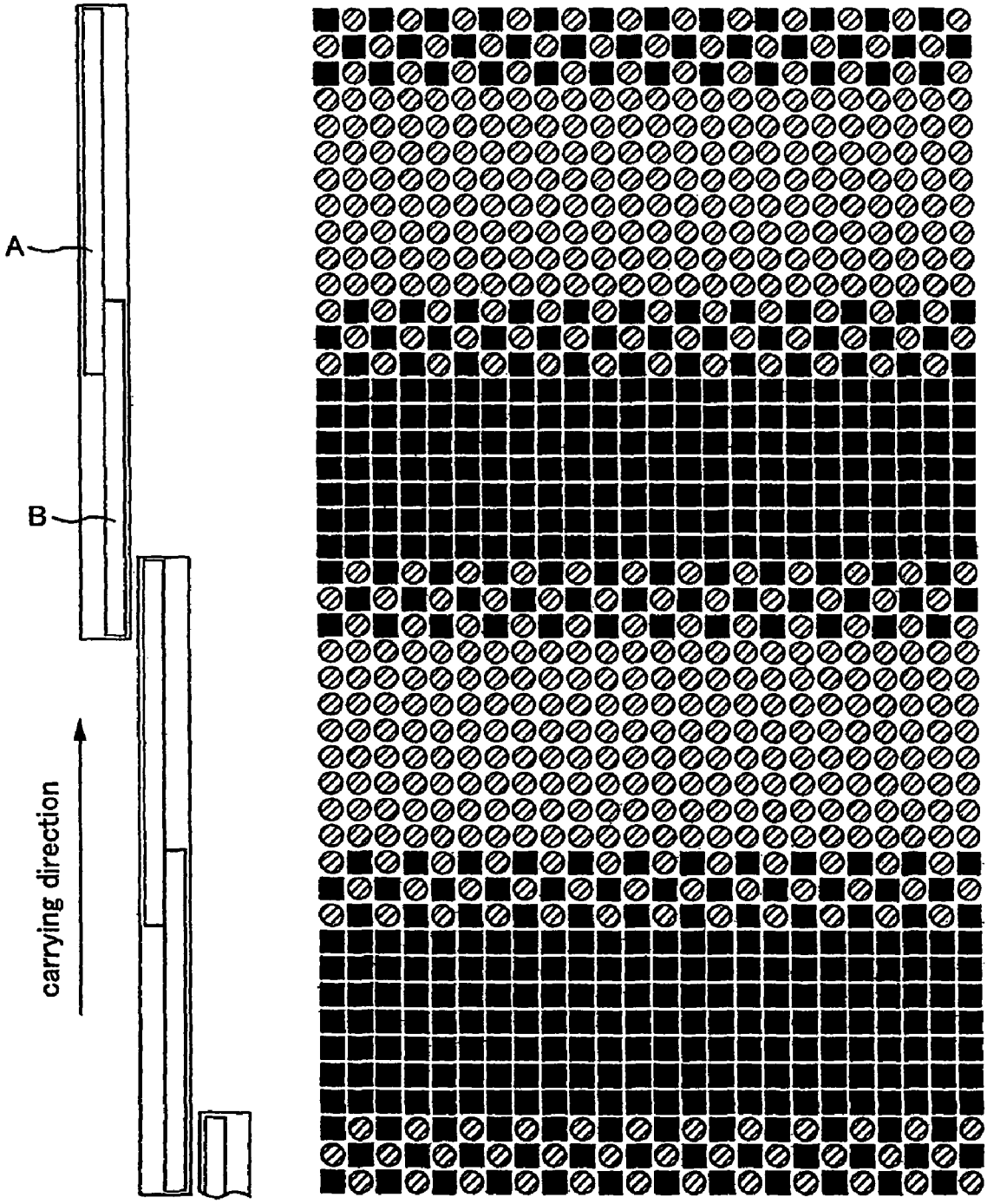
FIG. 18 is a diagram for describing an image printed using a third ink-droplet-ejecting method.

FIG. 18 is a diagram for explaining an image that is printed by a third ink-droplet-ejecting method.

In the second ink-droplet-ejecting method, dots that constitute a plurality of rasters printed with the aligned nozzle section and that are aligned in the carrying direction of the paper are printed using nozzles provided on the same print head; however, for the third ink-droplet-ejecting method, dots aligned in the carrying direction in adjacent rasters are printed by ejecting ink droplets from the nozzles of different print heads. That is to say, when a section that is printed by the aligned nozzle sections is examined, dots that are adjacent to one another in both the carrying direction of the paper and the movement direction of the carriage are formed by nozzles of different print heads. In this case, an overview of the raster dispersion process is as follows. In the flowchart shown in FIG. 14, the even-numbered dots that constitute the target raster are corrected; the method of this example can be achieved through processing that is substantially the same as in FIG. 14, by correcting the even-numbered dots when the unit offset NOF of the target raster is odd, and correcting the odd-numbered dots when the NOF is even.

<Fourth Ink-Droplet-Ejecting Method>

Figure 19:
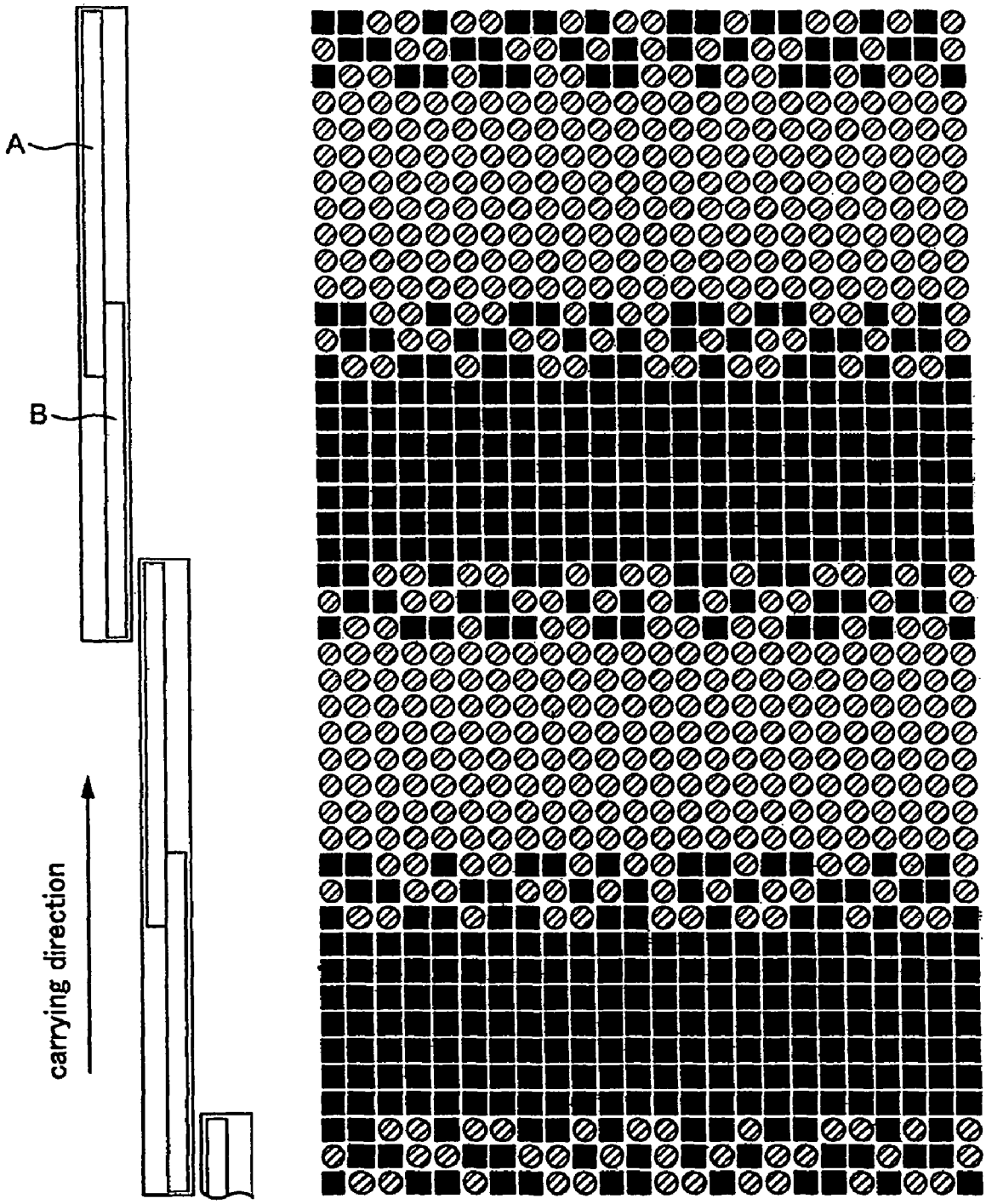
FIG. 19 is a diagram for describing an image printed using a fourth ink-droplet-ejecting method.

FIG. 19 is a diagram for explaining an image that is printed by a fourth ink-droplet-ejecting method.

In the third ink-droplet-ejecting method, no dots from the same print head are aligned in the paper carrying direction; however, the two types of dots are formed in a specific pattern. That is to say, if nozzles whose ink ejection characteristics differ, or nozzles whose ink trajectory is different from that of other nozzles are contained in the aligned nozzle sections, then the effect of those nozzles may appear periodically. Thus, in the fourth ink-droplet-ejecting method, in order to suppress the effect of a predetermined nozzle on an image, when correcting the dots in the aligned nozzle sections of the print heads, random numbers are generated and the dots to be corrected are selected randomly depending on, for example, whether or not the random number is larger than a predetermined threshold value or not. With the fourth ink-droplet-ejecting method, it is possible to suppress degradation in the image quality caused by the effect of a predetermined nozzle on an image, because the dots are not formed with a constant pattern.

<Fifth Ink-Droplet-Ejecting Method>

Figure 20:
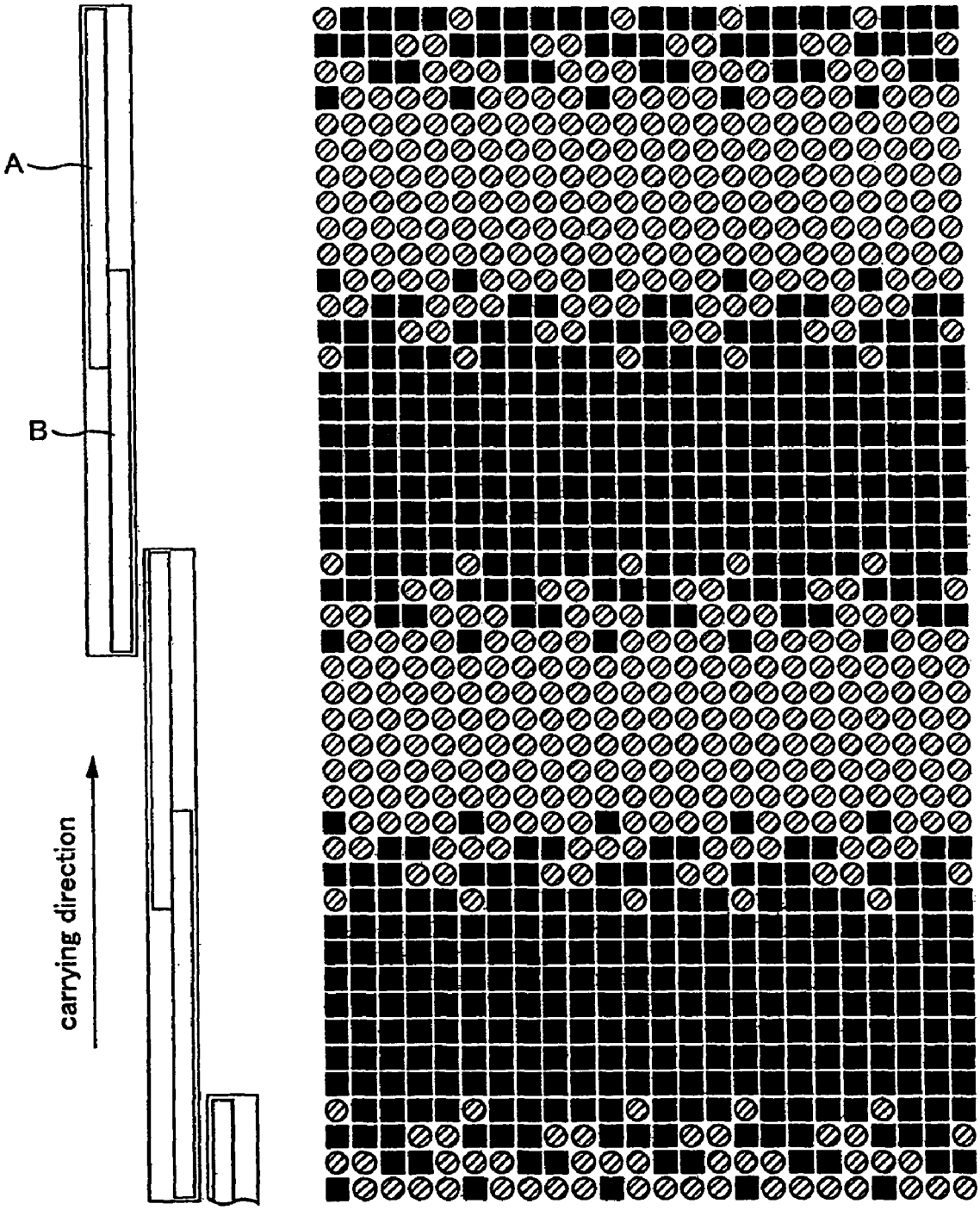
FIG. 20 is a diagram for describing an image printed using a fifth ink-droplet-ejecting method.

FIG. 20 is a diagram for explaining an image that is printed by a fifth ink-droplet-ejecting method.

In the fifth ink-droplet-ejecting method, the dots formed by two print heads in the aligned nozzle section of the print heads are not generated uniformly, but the ratio at which they are formed is gradually changed.

In the example shown in FIG. 20, the section in which the print head A and the print head B overlap is equal to four rasters. Thus, the ratio of the dots formed by the print heads changes over four levels, from the region in which all the dots are formed by print head A to the region in which all the dots are formed by print head B. More specifically, of the rasters printed by the aligned nozzle sections of the print head, 20% of the dots of the raster at the edge of the print head B are substituted with dots of the print head A. For the second raster from the edge of the print head B, 40% of the dots are substituted with dots of the print head A. For the third raster from the edge of the print head B, 60% of the dots are substituted, and further still, for the fourth raster from the edge, that is to say, the raster at the edge of the print head A, 80% of the dots are substituted with dots of the print head A. In this way, the dot-forming ratio in the aligned nozzle section is gradually changed such that the raster that is fifth from the edge is formed with all the dots formed by the print head A. Thus, in the aligned nozzle section of the print heads, the further the distance from the edge, the ratio at which the dots of that print head are formed increases, and the joint between print heads in the aligned nozzle section can be made unnoticeable further still. In the flowchart of FIG. 14, the even-numbered dots of the target raster are corrected; however, in the present method, the dots to be corrected can be gradually increased in accordance with the value of the nozzle row offset NOF.

Various examples of ink-droplet-ejecting methods have been described above; however, the present invention is not limited to the above-noted examples, and it may be embodied in various forms without departing from the gist thereof. For example, a software program (application program) achieving the above-noted functions may be supplied to and executed in the main memory of a computer system or an external storage device via a communications line.

===Setting the Ink-Droplet-Ejecting Method in the Aligned Nozzle Sections===

Five ink-droplet-ejecting methods have been described as examples of an ink-droplet-ejecting method in the aligned nozzle sections; if all the nozzles formed in the aligned nozzle sections are ideally formed and assembled, and if the ink droplets are ideally ejected, then it is possible to print a more favorable image by using the fifth ejecting method described above. However, there are cases in which the ink droplets are not ejected ideally from each print head, due to, for example, ejection characteristics of the ink droplets or error in precision of individual nozzles and in which a favorable image may not be printed. Furthermore, for example, if a print head is attached in a tilted manner, then, between the two adjacent print heads, there may be a difference in the number of nozzles in an aligned nozzle section between the nozzle rows that eject ink of the respective colors. In this case, as regards one of the nozzle rows of the aligned nozzle section, rasters are formed by ink that is ejected from a nozzle that was not supposed to eject ink; thus, a color shift, for example, may occur and a favorable image may not be printed.

Thus, in order to print a favorable image, when forming a single-color image of each ink color, the procedure uses an image that is actually printed to determine which ejecting method should be used for printing with the aligned nozzle section of the nozzle rows. That is to say, an image is actually printed by each of the aligned nozzle sections, the ejecting method by which a favorable image is printed by each of the aligned nozzle section is selected, and this ejecting method is set for each nozzle row individually as the ink-droplet-ejecting method for printing by the aligned nozzle sections.

In this case, it is preferable that the image to be printed is an image containing a pattern in which a phenomenon that causes the drop in image quality easily occurs. A preferable pattern, such as a pattern for confirming the occurrence of white streaks or black streaks if dots formed by ink droplets ejected from any nozzle are shifted in the carrying direction of the print paper, is an image in which striped images printed in gradations with each of the ink colors are arranged in the carrying direction. Furthermore, a pattern for confirming image roughness due to the dots that form the image caused by shifts in the positions where the dots are formed, that is to say, so-called graininess in which the exterior shape of dots in the image becomes noticeable, is a halftone image printed using small diameter dots and in which the amount of ink ejected per unit area is small.

These images are printed by altering the ejecting method for each aligned nozzle section, such that the region printed by each aligned nozzle section is joined with the regions printed by the independently-operating sections of the two print heads that constitute that aligned nozzle section. For example, a pattern is printed for each nozzle row for ejecting the same color ink by each ink ejecting method, such that a region a1 printed by the print head A shown in FIG. 10, a region ab1 that is printed by the aligned nozzle section AB of the print head A and the print head B, and a region b1 printed by the print head B are connected to one another in the carrying direction of the print paper. Furthermore, the same process is carried out for the print head B and the print head C, the print head C and the print head D, and the print head D and the print head A with the intervention of a print-paper carrying process.

Then, based on the printed images, the image that is printed with the most favorable image quality with each of the aligned nozzle sections is selected, and the ink-droplet-ejecting method of that image is set as the ink-droplet-ejecting method of the corresponding aligned nozzle section.

FIG. 21 is a diagram showing information stored in the memory as the ink-ejecting method of the aligned nozzle section of the nozzle rows of each ink color.

For example, if the print heads and the nozzles are ideally formed and assembled, the aligned nozzle sections AB, BC, CD and DA of the nozzle rows of the print head A and the print head B are all set to the fifth ink-droplet-ejecting method, and that information is stored in the memory.

If the print head B is attached in a tilted manner, as noted above, then, for example, the aligned nozzle section AB of the black nozzle row K is set so as to print with the third ink-droplet-ejecting method, the aligned nozzle section BC is set so as to print with the first ink-droplet-ejecting method, the aligned nozzle section CD is set so as to print with the fifth ink-droplet-ejecting method, and the aligned nozzle section DA is set so as to print with the fifth ink-droplet-ejecting method, and that information is stored in the memory 401.

Furthermore, the aligned nozzle section AB of the cyan nozzle row C is set so as to print with the fourth ink-droplet-ejecting method, the aligned nozzle section BC is set so as to print with the second ink-droplet-ejecting method, the aligned nozzle section CD is set so as to print with the fifth ink-droplet-ejecting method, and the aligned nozzle section DA is set so as to print with the fifth ink-droplet-ejecting method, and that information is stored in the memory 401.

Thus, the border section between regions printed by the respective print heads is made further unnoticeable by setting the ink ejecting methods such that the image is printed with the most favorable image quality with each of the aligned nozzle sections for each of the nozzle rows and for each ink color, and thus it is possible to print the entire image with favorable image quality.

With the printer 20 of the present embodiment, it is possible to set the ink-droplet-ejecting method individually for each nozzle row and for each aligned nozzle section made from nozzle rows provided on print heads 28 that are adjacent in the carrying direction, and thus it is possible to set the ink-droplet-ejecting method in accordance with the condition of the upstream-side nozzles and the downstream-side nozzles contained in the aligned nozzle sections. That is to say, it is possible to appropriately switch the nozzles that eject the ink droplets between the upstream-side nozzles of one print head and the downstream-side nozzles of the other print head to print the border section of each region printed by different print heads. Thus, white streaks, black streaks and roughness due to the dots caused by, for example, the ejection characteristics of the ink droplets or errors in the ejection precision of the ink droplets in the upstream-side nozzles and the downstream-side nozzles are less prone to occur in the border sections of the print regions that are printed by two different print heads, and thus it is possible to suppress a reduction in image quality.

Furthermore, it is possible to print a favorable image by setting the ink-droplet-ejecting method in accordance with the number of aligned nozzles of the aligned nozzle sections. In particular, it is possible to print a favorable image by an ink-droplet-ejecting method that is set according to the number of nozzles aligned in the aligned nozzle section, even if the number of nozzles that are aligned differs for each nozzle row due to errors in, for example, the attachment of each print head 28 due to the aligned nozzle sections being provided on different print heads 28.

Moreover, since the ink-droplet-ejecting method is set for each aligned nozzle section based on patterns that are actually printed using the methods for ejecting ink droplets with each of the aligned nozzle sections, it is possible to set the ink-droplet-ejecting method that is most appropriate as the ejecting method for each aligned nozzle section based on the pattern that is printed. Thus, it is possible to print a more favorable image.

As described above, the printing method of the present embodiment involves preparing a printer 20 that has: at least two print heads 28 that move in a movement direction intersecting a carrying direction, each of the print heads 28 including a plurality of nozzle rows, each of the nozzle rows including a plurality of nozzles n that are arranged in the carrying direction and that are capable of forming dots by ejecting ink droplets onto a print paper P that is carried in the carrying direction, and a plurality of aligned nozzle sections AB, BC, and CD aligned in the movement direction, each of the aligned nozzle sections being constituted by at least one downstream-side nozzle that is positioned on the downstream side in the carrying direction of the nozzle rows provided in one of the print heads 28 and at least one upstream-side nozzle that is positioned on the upstream side of the nozzle rows provided in another one of the print heads 28. The method further includes (a) a step of setting, for each of the aligned nozzle sections AB, BC, and CD, one ejecting method of among a plurality of ejecting methods employing different ways of using the at least one upstream-side nozzle and the at least one downstream-side nozzle when the print heads 28 move in the movement direction; and (b) a step of ejecting ink droplets from the aligned nozzle sections AB, BC, and CD according to the one ejecting method that has been set for each of the aligned nozzle sections.

===OTHER EMBODIMENTS ===

The present invention is not limited to the above-described embodiments, and various modifications are possible without departing from the gist of the invention. For example, the following modifications are possible:

(1) In the foregoing embodiments, some of the configuration that are achieved by hardware may be replaced by software, and conversely, some of the configuration that are achieved by software may be replaced by hardware.

(2) The present invention can be applied to any type of printing apparatus that ejects ink droplets, and can be applied to a variety of printing apparatuses besides color inkjet printers. For example, it can also be applied to inkjet facsimile devices or copiers.

<<<Configuration of Printing System etc.>>>

Next, implementations of a printing system and a computer program serving as an example of an embodiment of the present invention are described with reference to the drawings.

Figure 22:
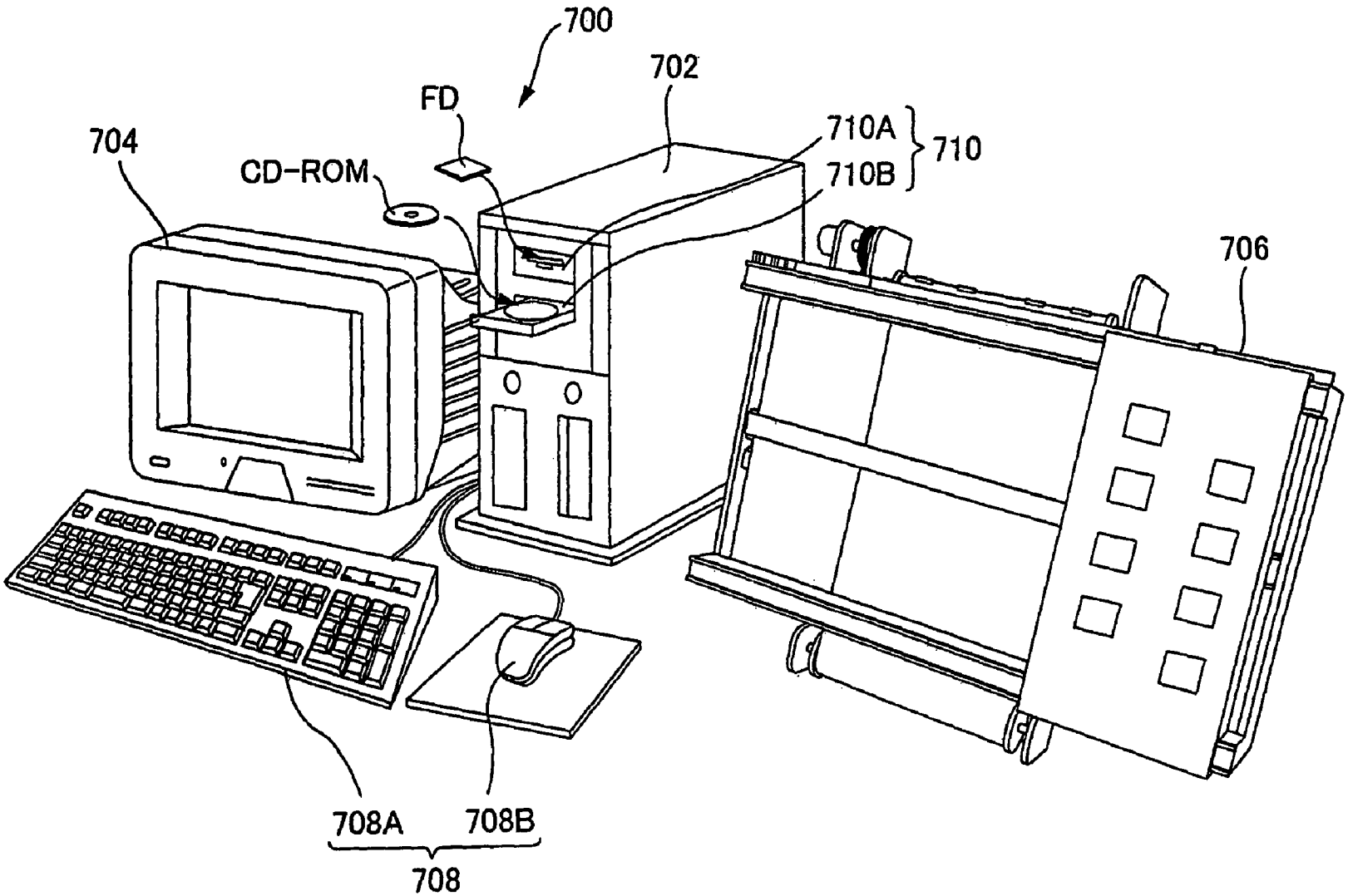
FIG. 22 is an explanatory diagram that shows an external view of the structure of a printing system.

FIG. 22 is an explanatory diagram showing the external structure of the printing system. A computer system 700 is provided with a main computer unit 702, a display device 704, a printer 706, an input device 708, and a reading device 710. In the case of such a printing system, the image processing section of the controller of the printer in the above-noted embodiments is not absolutely necessary, and converting image data to print data may be executed as processing by a printer driver installed in the main computer unit 702. A CRT (cathode ray tube), plasma display, or liquid crystal display device, for example, is generally used as the display device 704, but there is no limitation to this. The printer 706 is the printer described above. In this embodiment, the input device 708 is a keyboard 708A and a mouse 708B, but there is no limitation to these. In this embodiment, a flexible disk drive device 710A and a CD-ROM drive device 710B are used as the reading device 710, but there is no limitation to these, and the reading device 710 may also be a MO (Magneto Optical) disk drive device or a DVD (Digital Versatile Disk), for example.

Figure 23:
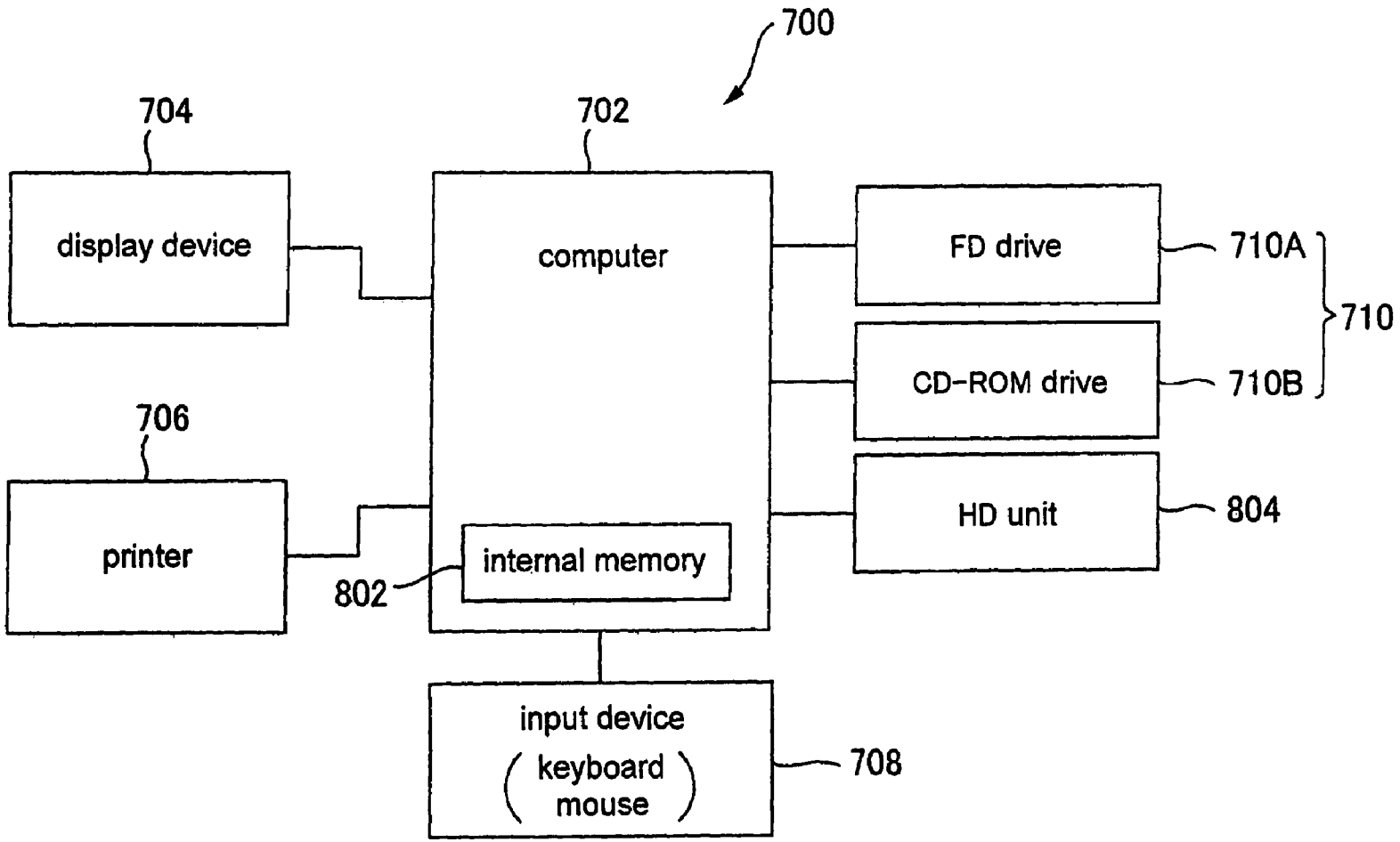
FIG. 23 is a block diagram showing the structure of the printing system shown in FIG. 22.

FIG. 23 is a block diagram showing the configuration of the printing system shown in FIG. 22. An internal memory 802 such as a RAM is provided within the housing accommodating the main computer unit 702, and also an external memory such as a hard disk drive unit 804 is provided.

In the above description, an example was described in which the computer system is constituted by connecting the printer 706 to the main computer unit 702, the display device 704, the input device 708, and the reading device 710; however, this is not a limitation. For example, the computer system can be made of the main computer unit 702 and the printer 706, and the printing system does not have to be provided with any of the display device 704, the input device 708, and the reading device 710.

It is also possible for the printer 706 to have some of the functions or mechanisms of the main computer unit 702, the display device 704, the input device 708, and the reading device 710. For example, the printer 706 may be configured so as to have an image processing section for carrying out image processing, a display section for carrying out various types of displays, and a recording media attachment/detachment section to and from which recording media storing image data captured by a digital camera or the like are inserted and taken out.

Moreover, the computer program that controls the printer in the foregoing embodiment may be stored in a memory of a printer controller, and the operations of the printer of the foregoing embodiment may be achieved by the printer controller executing this computer program.

As an overall system, the printing system that is thus achieved is superior to conventional systems.

What is claimed is:

1. A printing apparatus that prints an image by ejecting ink from nozzles onto a medium that is transported in a transporting direction, the printing apparatus comprising:

a) a first print head, mounted on a carriage moving in a carriage movement direction during printing, provided with a plurality of nozzle rows for respective colors of the ink, each of the plurality of nozzle rows including nozzles which are arranged in a row along the transporting direction;

b) a second print head mounted on the carriage and provided with a plurality of nozzle rows for respective colors of the ink, a section of the each nozzle row of the second print head overlapping a section of the each nozzle row of the first print head to form an aligned nozzle section along the carriage movement direction and wherein the each nozzle row of the second print head at most partially overlaps the each nozzle row of the first print head in the carriage movement direction;

c) a memory that stores information about a number of nozzles in each of the aligned nozzle sections for each color of the ink; and d) a controller that controls a timing at which the ink is ejected from the first and second print heads based on the information about the number of nozzles in each of the aligned nozzle sections.

2. A printing apparatus according to claim 1, wherein, for each color of the ink, an ink-ejection algorithm for each of the aligned nozzle sections is stored in the memory.

3. A printing method of printing an image by ejecting ink from nozzles onto a medium that is transported in a transporting direction, the printing method comprising:

a) preparing a printing apparatus having a first print head, mounted on a carriage moving in a carriage movement direction during printing, and provided with a plurality of nozzle rows for respective colors of the ink, each of the plurality of nozzle rows including nozzles which are arranged in a row along the transporting direction and a second print head mounted on the carriage and provided with a plurality of nozzle rows for respective colors of the ink, a section of the each nozzle row of the second print head overlapping a section of the each nozzle row of the first print head to form an aligned nozzle section along the carriage movement direction and wherein the each nozzle row of the second print head at most partially overlaps the each nozzle row of the first print head in the carriage movement direction;

b) forming a print pattern on the medium in such a manner that the first and second print heads move in a direction intersecting the transporting direction and eject the ink of the respective colors;

c) storing information about a number of nozzles in each of the aligned row sections for each color of the ink; and d) controlling a timing at which the ink is ejected from the first and second print heads based on the information about the number of nozzles in each of the aligned nozzle sections.

* * * * *